US005821697A

United States Patent [19]

Weber

[11] Patent Number: 5,821,697

[45] Date of Patent: Oct. 13, 1998

[54] CONSTANT INTENSITY ELECTRONIC FLASHLIGHT AND LANTERN METHOD AND APPARATUS

[75] Inventor: Harold J. Weber, Holliston, Mass.

[73] Assignee: Conceptra Patent Trust, Centerville, Mass.

[21] Appl. No.: 387,481

[22] Filed: Feb. 13, 1995

[51] Int. Cl.[6] ..... H05B 37/02

[52] U.S. Cl. ..... 315/200 A; 323/281; 315/307

[58] Field of Search ..... 315/200 A, 307, 315/33; 323/265, 273, 280, 281, 905; 362/158

[56] References Cited

U.S. PATENT DOCUMENTS

| | | | |
|---|---|---|---|
| 1,189,794 | 7/1916 | Creveling | 315/307 |
| 3,947,753 | 3/1976 | Gushima et al. | 323/21 |
| 4,499,525 | 2/1985 | Mallory | 362/157 |
| 4,725,759 | 2/1988 | Tachikawa | 315/51 |

*Primary Examiner*—Robert J. Pascal
*Assistant Examiner*—Michael Shingleton

[57] ABSTRACT

An about constant brightness level of light output is produced from portable battery operated incandescent light sources, such as flashlights, emergency lights and lanterns, throughout the full discharge and terminal voltage decay of the electrochemical charge life of a set of batteries. Instant levels of power flow between the battery and the light source's incandescent bulb are dynamically controlled. When the battery is fresh a reduced portion of the available battery power flows to the light bulb. As at least a portion of the battery wears-down, and charge decreases, the remaining portion of the battery power flow increases thereby keeping the light bulb's filament operating near optimal efficiency and with visually desirable "white-light" brightness. A further advantage is that fewer changes of dry-cell battery sets are needed in order to maintain the light source near peak performance. As the battery finally nears full discharge, an indicator may serve to signal imminent battery failure and the need for replacement. Aside from the constant level of illumination and lower cost flashlight operation, an improved level of environmental responsibility occurs due to fewer drycell battery replacements resulting in reduced battery manufacturing related energy consumption and a reduction in sheer quantity of prematurely replaced potentially contaminating chemical containing drycell batteries being discarded into landfills.

20 Claims, 26 Drawing Sheets

CONSTANT INTENSITY ELECTRONIC FLASHLIGHT AND LANTERN METHOD AND APPARATUS

FIELD OF INVENTION

My invention pertains to portable battery operated light sources and especially to flashlights, portable lanterns, electric candles, electric torches, signal lights, and emergency lighting devices. In particular my invention concerns itself with small incandescent light sources that ordinarily operate from primary type carbon-zinc, alkaline or lithium dry-cell batteries, or rechargable "ni-cad" (nickel-cadmium) dry-cell batteries. The primary battery types may include aqueous electrolyte manganese dioxide cells having zinc carbon or zinc chloride construction as well as manganese alkaline composition. Batteries of these types (and in particular common and relatively inexpensive zinc carbon and zinc chloride batteries) ordinarily exhibit a substantial drop in loaded terminal potential and a marked impedance increase during their useful discharge life.

My invention also relates to premium quality or "professional" grade flashlights and other portable light sources where consistent light quality, extended operation and long battery life are of essential importance. My intent is to embelish the performance of these types of high performance professional flashlights to achieve a here-to-fore unparalleled higher quality of "bright and white" light produced by the lamp for a longer period of time along with a worthwhile reduction in battery set consumption and attendant replacement cost in order to beneficially maintain the higher level of light quality.

DISCUSSION OF PRIOR ART

Ordinarily, flashlights and other such portable illumination apparatus merely employ a seriate circuit arrangement including a battery (consisting of one or more cells), a small incandescent light bulb and an "on/off" switch. From a low cost point of view, such a basic combination may be cost effective for some simple or occasional use applications such as a flashlight kept by a homeowner to "find" the fusebox or a compact light kept on a keychain to help locate a keyhole late at night. Operation of this sort of primative arrangement primarily depends upon battery quality to achieve acceptable performance. In practice, the light produced by the lamp deteriorates in illuminative quality in nearly exponential relation to battery charge decay. This dropoff in apparant performance translates into frequent battery replacement resulting in an unnecessary expense for the user and need for an unecessarily wasteful disposal of millions of prematurely discarded chemical laden battery cells in environmentally sensitive landfills.

Figure 1:
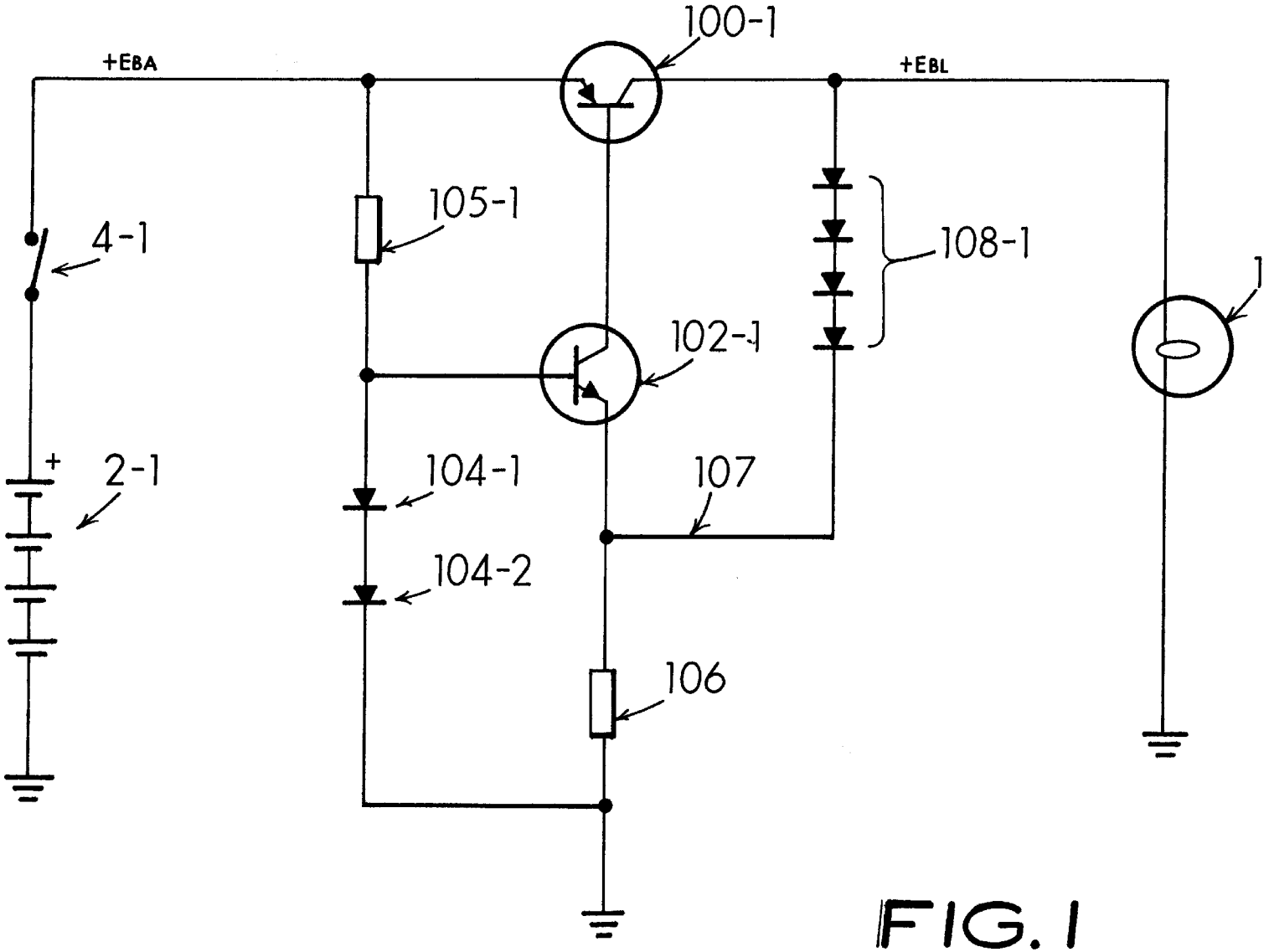
Figure 3:
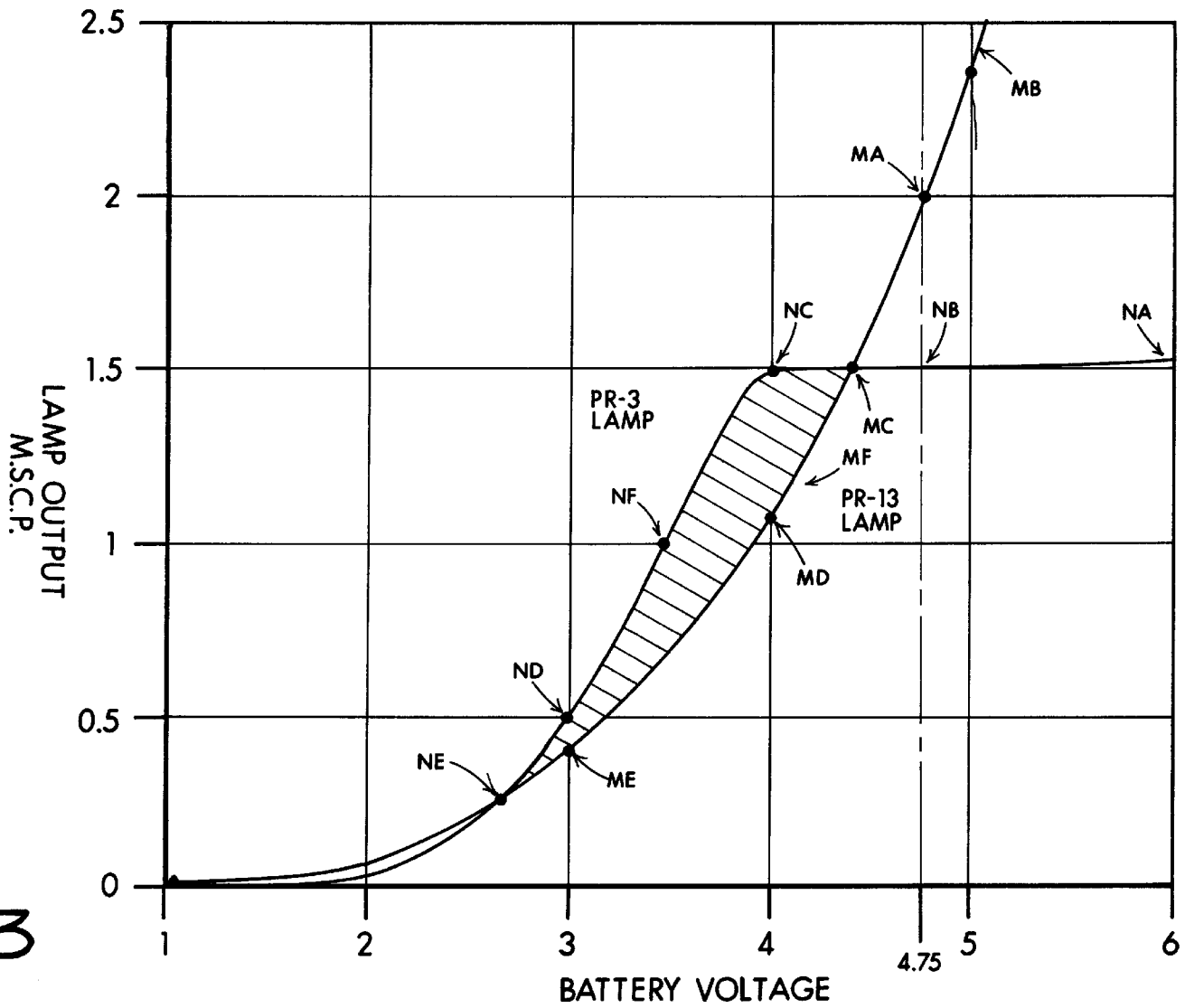

A previous U.S. Pat. No. 4,499,525 issued to Henry Mallory describes how traditional batteries ordinarily show very poor voltage maintenance characteristics over their useful service life. In particular, in FIG. 2 of his patent he illustrates the poor terminal voltage regulation characteristic of common batteries including aqueous zinc chloride and ammonium chloride electrolyte and manganese dioxide cells such as those of zinc carbon or zinc chloride or manganese alkaline construction. He shows how the initial light produced from a representative industry type 908 commercial battery, measured in lumens, may rapidly drop from an initial value of 40–50 lumens when first turned-on to about 30 lumens in merely about 20 minutes after the battery is put into service. The lamp then decays further to about 23 lumens in the first hour and again drops rapidly after 3 hours from about 17 to less than 10 lumens. What the curve fails to depict, but Mallory mentions in his patent (col. 1, lines 35–40) is that the light changes "from an initial white light output to a noticeably yellow light output, which is considered to be a negative factor from a consumer acceptance point of view". To paraphrase, this simply means the consumer replaces the battery when the light becomes objectionably yellow, is perceived as "dim" and usually well before the economic battery life of even an hour's worth of operation has been obtained. In his patent, Mallory attempted to overcome battery potential decay through the expedient of providing a pulse-width modulated voltage regulator circuit intercoupled between the battery and the lamp. The substance of his invention is that of a depiction of a specific, albeit unique, circuit embodiment as described throughout his specification, drawings and claims. It is well-known, long established and plainly true engineering knowledge that maintaining an incandescent lightbulb's filament voltage about constant irrespective of any change in source voltage (such as that brought on by battery discharge) results in a better quality light source. As a result, the essence of this earlier '525 patent is not that of the fundamental foreknown concept of maintaining an incandescent filament at a constant operating level but rather it focuses upon the mere, albeit alegedly unique, combination of certain elements in a particular arrangement to achieve control of the filament operating level. In Mallory's circuitry, dependence upon circuit gain is fundamental to proper circuit operation. In FIG. 1 of the '525 patent, he illustrates the use of a small PNP transistor (18) as the base current source for a NPN power transistor (16). It should be recalled that in transistor performance, extremely low collector to emitter voltage operation, high current gain and low cost do not necessarily coincide. For example, if the type 908 battery (12) delivers about six volts, the current available to the base of the transistor (18 through resistors (30, 34) may at best be about:

$$Iba = \frac{(Eba - Ebe)}{(Raa + Rab)} = \frac{(6 - 0.7)}{(5.6 + 18)} = \frac{5.3}{23.6} = 0.225 \text{ Ma}$$

while the lamp (10) may require about 500 milliamperes through the power transistor (16). This says that the overall minimum current gain of the two devices must exceed 500 Ma/0.225 Ma=2222 (combined beta) or an average current gain (beta) of at least 47 per transistor in order to "cause fully saturated conduction of the transistor 16" (col. 3, lines 41–42). This requirement for relatively high transistor beta is further exemplified when the embodiment of FIG. 3 is viewed wherein the lamp (46) may require about 950 milliamperes. In this case, the minimum combined current gain of the two transistors (18,46) must be at least 950 Ma/0.225 Ma=4,222 (combined beta) or an average current gain beta in excess of 65 per transistor. As a furtherence of this point, if the battery voltage drops to about 4 volts (and useful life is still attainable at this level), on a pro rata basis the average gain of the transistors in the FIG. 1 embodiment would have to be at least 60 whereas, for FIG. 3, the average gain of each device would have to be at least 83. Although this requirement might be satisfied by an NPN pass transistor (46) having a "high beta" (sic) of 10 "where the base current required during conduction is approximately 10% of its emitter to collector current" (col. 3, lines 36–43), the other PNP transistor (18) would then require a minimum beta of 689 (and more preferably a beta substantially higher) to assure deep saturation of the pass transistor (46) in order to obtain the "the small voltage drop of approximately ¼ volt" across the transistor (col. 4, lines 43–44) particularly when the battery voltage has declined to a level where the diodes 26 are no longer operative.

Yet another obscure, albeit appreciable, loss occurs in the Mallory apparatus. The control transistor (18) collector is directly coupled to the drive transistor (16) base without benefit of an intermediate current limiting resistor or impedance. In other words when the control transistor (18) is turned ON, maximum current flow as determined by a product of the base current injected into the transistor (18) and the effective beta of the transistor (18) determines the base current of the drive transistor (16). In effect what this means is that ordinarily the base current flowing through the drive transistor 16 may be substantially higher than necessary in order to maintain the desired level of collector current flow between the drive transistor (16) and the lamp (10), albeit such gross overdrive of the base of the drive transistor (16) is advantageous in order to obtain the low voltage drop of "approximately ¼ volt across transistor 16" as said by Mallory. Mallory solves this deficiency in his invention through the expedient of unique selection of the transistor (18). In col. 3, lines 54–56 he says: "Transistor 18 is selected to supply an emitter current of 50 milliamps or less to the base of drive transistor 16 to drive the latter in a fully saturated mode." In effect, this says that his invention's embodiment is "tuned" (through component selection) to achieve the sought performance and in practice the level of performance described by the '525 patent may not be attainable in practical mass-produced apparatus utilizing commonplace, cost-effective components with inherent tolerance spreads usual to the art. It is important to realize that the teaching of Mallory does not anticipate the use of current limited operation in order to decrease the battery drain.

What this investigation of the obvious operation of Mallory shows is that the transistors used by Mallory are necessarily exceptional in performance particularly at the very low voltage operating levels encountered in this sort of application and therefore specific selection of suitable devices, aside from being less economic than more run-of-the-mill devices, may also produce irregular performance and higher cost when utilized in the manufacture of commercial quantities of flashlights or other products.

In order to obtain the oscillatory conditions claimed by and essential to attain the performance stated by Mallory the transistors must exhibit exceptional high beta performance in order to obtain the needed overall circuit gain. Resistor (34) in particular and also resistors (22,28,30) might be reduced in value, but this necessitates a substantial increase in the value of at least capacitor (24) in order to provide appropriate time constants for feedback and oscillation.

Additionally, Mallory proposes a type 908 lantern battery (col. 3, lines 27–28) but other battery combinations may be more desirable for such apparatus to be universally acceptable in flashlight operation. For example, series combinations of trade designated D, C or even AA cells may be more appropriate or more cost effective in many applications. An intrinsic characteristic of common batteries going through their discharge cycle is that a marked increase in internal resistance (or impedance) of the individual cells occurs. In the operation of Mallory's circuit, this means that when the transistor (16) "turns-on", current draw by the lamp (10) causes a significant voltage drop across the battery (12) resulting in a drop in voltage potential at the juncture of resistor (30) with the battery. In effect, this is a form of negative feedback which serves to reduce, not enhance, the net current gain afforded by the combination of the transistors (16,18) or transistors (18,46). Aside from reducing the likelihood of achieving an efficient mode for quick and fully saturated operation of the series pass transistor (16), negative feedback may also reduce the propensity for the circuit to reliably oscillate under a broad range of operating conditions, battery choices and other parametric changes in circuit operation, component tolerance or operating environment.

Mallory believes that his invention operates with low internal power loss (col. 1, lines 66–68; col. 2, lines 1–2). However, further evaluation of the data provided by Mallory contradicts this belief and shows that the obtained efficiencies are unexceptional. Consider the following data obtained from Table I and Table II of Mallory (cols. 5 and 6):

| US Pat. No. 4,499,525 Incandescent Lamp | | From Table I Type PR-2 | From Table II Type PRL-2 |
|---|---|---|---|
| Volts | EL | 2.38 | 2.75 |
| Amperes | IL | 0.50 | 0.95 |
| Watts | WL | 1.19 | 2.61 |
| Battery Drain Watts | | | |
| 6 volt level | WBA | 1.41 | 3.12 |
| 4 volt level | WBB | 1.24 | 3.40 |
| Light Output Lumens | | | |
| 6 volt level | OLA | 10.8 | 24.6 Lumens |
| 4 volt level | OLB | 7.7 | 24.5 Lumens |
| Net 6-volt Efficiency | | | |
| (WL/WBA) | Note 1 | 84.4% | 83.6% |
| Net 4-volt Efficiency | | | |
| (OLB/OLA) × (WL/WBB) | | 68.4% | 76.4% |

Notes: (1) the 6 volt efficiency represents merely the relationship between lamp (output) power and battery drain (input) power from the tables.

It is noteworthy that the falloff in light output lumens in Table I belies the remaining fact that the 29% decrease in measured brightness in lumens is accompanied by a substantial "yellowing" of the resulting light and a loss of visual quality.

I have been unable to duplicate the alleged efficiency set forth by Mallory in his Tables I and II. In particular, actual measured current draw from the battery has appeared substantially higher over the 4 to 6 volt region than what Mallory has shown, with actual current draw being about 100 milliamperes greater than that shown in Table I. As admitted by Mallory, the "data was derived from measuring the illumination output of bulb 10, the voltage output of battery 12 and the frequency of the output pulse train. The average current of the pulse train and the power figures where then computed on the basis of these measurements." (See '525 col. 5, lines 23–42; col. 6, lines 20–25.) As a result of these findings, I propose that the measurable operational efficiency of the '525 patent is about:

Net 6-volt Efficiency (WL/WBA)=1.19 W/(6V×0.335 A)=59.2%

Net 4-volt Efficiency (OLB/OLA)×(WL/WBB)=(7.7 L/10.8 L)×(1.19 W/(4V×0.410 A))=51.8%

Note: PR-2 lamp=(2.38V×0.5 A)=1.19 W

It is not clear from Mallory's teaching why the circuit of FIG. 3 of '525 appears to maintain considerably better light constancy than what the circuit of FIG. 1 obtains. I must conclude that differences in the pass transistor (46) current gain factor might be a source of such discrepancy since, aside from usage of the larger transistor (46) and the PRL2 krypton lamp, all other circuit values remain essentially the same. I propose that this difference in circuit performance merely underscores my foregoing discussion wherein transistor current gain is said to be a critical parameter in the consistent and predictable performance of this circuit form invention.

SUMMARY OF PRIOR ART

In-so-far as I know, U.S. Pat. No. 4,499,525 issued to Henry Mallory is the principle prior art relative with the field of my invention. In the foregoing discussion, I show that the '525 patent, which if stripped to its essentials is merely a self-oscillating hybrid pulse position and pulse width modulated regulator. The '525 patent aims primarily at defining a particular embodiment for a self-oscillating circuit which may satisfy certain goals for providing stabilized operation of a low voltage lamp from a dry cell battery. Characteristic of a switching regulator of this type, considerable losses can occur if switching is not abrupt. In order to attain abrupt switching of the pass transistor 16, Mallory resorts to base current overdrive. As a result, considerable power is lost in this switching mode. This shortfall is discussed to some additional length in my description of the instant invention.

BACKGROUND OF INVENTION

Dry battery operation of light bulbs is notoriously well known in the construction of flashlights, portable lanterns, signal lights, electric candles and emergency lighting devices. A particular class of apparatus is the so-called "sportsman's" flashlight which ordinarily consists of a 4-cell 6-volt dry cell battery (e.g., Eveready type 509; or Ray-O-Vac type 941 or 944) and a prefocused incandescent light bulb (e.g., type PR-12 or PR-13) which draws about ½ ampere. Arranged together with an optical reflector and suitable housing this kind of device finds widespread use by not only sportsmen, but also contractors, homeowners, security guards, law enforcement officers, ambulance personnel, soldiers and other persons needing a reliable, bright source of portable light.

Dry cell batteries, while comparatively cheap and predictably reliable, do suffer several shortcomings which introduce problems in the overall satisfactory performance of this kind of "heavy duty" flashlight. As is well known, dry cell batteries not only deteriorate from use, but their performance (e.g., chemical activity) degrades as the temperature is lowered, resulting in an apparent increase in their internal impedance that produces "dim" light even from a known "fresh" battery. Terminal voltage produced by dry cell batteries also tends to drop rather rapidly after a relatively brief period of initial useage, whereupon the voltage "levels-off" and a considerable amount of power remains in the battery for whatever load is connected to it. In effect the operative curve of a typical dry-cell battery exhibits three pronounced performance regions. Internal impedance of the battery increases rapidly during the first portion of its operational life. During the second more constant portion of it's operational life the impedance tends to level off until the battery's performance becomes nearly exhausted. Finally, during the third portion of its overall performance the impedance again rapidly increases to the point where the battery has no further practical value.

This condition is aggravated by the fact that a flashlight bulb, such as the common type PR-12 (5.95V, 0.5 A) incandescent light bulb, is fundamentally a tungsten filament device which looses about 20% of its light output with merely about a 7% drop in battery terminal voltage, while a 20% drop in battery voltage cuts the light output fully in half. In practice, what this means is that an awful lot of batteries which are still "perfectly good" and still retain considerable operating potential are discarded after a relatively short period of initial use at unnecessary expense to the user, and with considerable waste of environmental resources used in the manufacture of the batteries and not forgetting to consider the increasingly problematic matter of waste disposal of the multi-millions of prematurely (and unecessarily) discarded chemical laden batteries.

It is well established in the field of dry cell battery engineering that at least 33% drop in the battery's full load terminal voltage ought to determine battery exhaustion. Under such a condition, the light output from a common incandescent light bulb such as the type PR-12 would decrease to a mere 26%. In use, the light appears even dimmer due to the objectionable "yellow" appearing light produced at such low terminal voltage. In reality, the light "yellows" and becomes objectionable with merely a 10–20% decrease in battery voltage, and this decrease of achromatic light results in premature and expensive battery changes by many critical users of portable dry-cell operated lights. Scarcely any battery operated light is considered useful with batteries so deeply discharged as to produce anything approaching the 33% drop in terminal voltage.

Designers of flashlights and particularly lanterns have for a long time made trade-offs between battery voltage and lamp voltage. For example, using four "D" cell batteries in a flashlight produces an open-circuit terminal voltage of about 6 volts. It is also common practice to use a type PR-13 lamp in such an arrangement, because the PR-13 lamp is rated 4.75 volts and the designer knows from experience that the battery terminal voltage will quickly fall from 6 to about 4.75 volts. Prior to dropping to the 4.75 volt level, however, the overvoltage battery level will bring about additional wear and tear on the lamp, resulting in premature failure, or at least shortening the life to much less than the ordinarily rated 15 hours. More subtle is the "really bright" performance afforded by fresh batteries, due to the over-voltage operation of the lamp, accompanied with a quick falling-off of this initial extraordinary performance to a more moderate, and likely more normal, operating level. An average person (who quite reasonably may assume the over-voltage and extra-bright operation of the lamp is really "normal") may become disappointed with this change in apparent performance of the flashlight or lantern and (albeit unwarrantedly) presume that the quality of the batteries, or of the light itself, is poor. Additionally, the overvoltage operation of the (PR-13) lamp (from 4 "D" cells or "6 volt" lantern battery) results in increased current draw and quicker depreciation of the battery capacity.

More recently, the problem of premature battery failure has become even more exasperated with the use of "Krypton" gas filled flashlight bulbs. For example, while an ordinary classic PR-3 lamp draws about 3.57 volts at 0.5 amperes (1.79 watts), these newer lamps (typified by Phillips type KPR-103, Ray-O-Vac type K3-2, and Garrity Industries type K3) consume about 60% MORE current (3.57 volts, 0.8 amperes, 2.86 watts) and as such drain the battery down to less than full rated voltage more rapidly than ever. Krypton lamps are ordinarily used in premium priced lanterns and flashlights, and as such the customer expects better performance but instead gets poorer performance from his batteries. Some manufacturers have resorted to placing warning labels on their lanterns and flashlights, telling the customer that his batteries will not last as long. You can now see why my invention has unique importance for use with these premium, heavy duty kinds of flashlights having Krypton lamps. The usefulness of the batteries will last much longer, while the lamp produces constant bright achromatic light resulting in an advantageous and here-to-fore unobtainable combination.

OBJECTIVES OF MY INVENTION

In view of the several shortcomings of prior battery operated lights, and particularly dry-cell operated flashlights and lanterns, in regards to obtaining a full measure of battery power combined with a satisfactory level of bright "white" light, it is now my overall objective and purpose to make known methods, together with apparatus for practicing these methods, which overcome most, if not all, of these previous-art shortcomings.

My invention's objective is to overcome severe deficiencies characteristic of prior battery operated lights and particularly dry-cell operated flashlights and lanterns. My invention also addresses the inadequacies of previous attempts by others to obtain better battery utilization. In particular, my present objective is to obtain a full measure of battery power usage over the full discharge cycle of ordinary batteries while at the same time producing a satisfactory and relatively constant level of bright "white" light. Additionally, my invention's objective is to attain this level of remarkable overall performance without resorting to utilization of uniquely selected components and without an inherent necessity for twiddling with circuit parameters. Furthermore I provide this level of performance with only a few minimal cost parts.

To understand my invention is to realize that it is an environmentally sound energy conserving apparatus which extends the quality "white light" operation of any given set of dry-cell batteries far beyond that which is here-to-fore usually obtainable and thereby conserving not only the energy needed for manufacture of additional, oftimes prematurely replaced batteries in older apparatus, but also it contributes to reducing environmental pollution through less frequent discard of here-to-fore unecessarily replaced dry cell batteries including their chemical components.

It is therefore a fundamental purpose of my invention to produce a more achromatic "whiter" and "brighter" light from a flashlight or other small dry-cell battery operated incandescent lighting device for a longer period of time between battery replacements.

Moreover, a broader purpose of my invention to provide a practical method for extending useful battery life in all sorts of battery operated portable lighting devices.

It is another purpose of my invention to show a method whereby substantially full light output can be obtained from ordinary portable lighting devices even with a dry-cell battery that is partially or almost fully discharged.

An objective for my invention is to improve the perceived visual quality of light produced by portable, dry-cell operated lighting devices.

An important goal for my invention is to obtain considerably extended "useful" dry-cell battery life in battery operated lighting devices.

A further teaching of my invention is to show the use of a set of dry cell batteries whereby several of the cells making up the battery set provide the initial power for lamp operation and upon their depletion to a predetermined extent one or more additional cells are automatically electrically piggybacked with the partially depleted cells to boost the effective voltage level available for lamp operation.

In yet another form of my invention I show two sets of batteries whereby the first set is utilized to initially power the lamp and when the voltage levels drop below bounds at least a portion of the power available from the second battery set is coupled with the lamp.

Still another purpose of my invention is to teach a method for obtaining an increase in dry cell battery usefulness and life expectancy with negligible degradation in the overall quality of light output produced by a lighting device operated by the battery between that of when the battery is "fresh" and when the battery is "exhausted".

Another goal is to teach a method for practicing my invention which utilizes inexpensive apparatus having predetermined parameters and requiring no adjustment or extraordinary component selection during manufacture or use.

Another objective for my invention is to produce essentially full light output from ordinary incandescent, dry-cell operated light bulbs, even when the battery is discharged to a level producing about ⅔ terminal voltage potential or less.

Yet another intent of my invention is to provide a signal, such as a small telltale light, warning that the battery is nearing full-discharge and ought to be replaced.

SUMMARY OF MY INVENTION

My invention controls the level of d.c. power coupled between a battery and a small incandescent light bulb in portable light sources, such as flashlights, lanterns, emergency lighting devices, and so forth. A decrease of at least 33% in battery output is readily accommodated by my invention, while maintaining a FULL and CONSTANT level of light output from any light source ordinarily associated with my invention. A common 6-volt "lantern" battery (e.g., Ray-O-Vac type 941) continues to produce a constant level of full brightness illumination from the light bulb when the battery's terminal voltage drops from 6 volts to less than 4 volts. The result is an exceptional capability for obtaining a considerably increased lifetime from ordinary dry cell batteries, while at the same time providing a constant and bright "white" light that is so essential to efficient and prolonged use of portable light sources such as flashlights.

My invention now carefully teaches immediate advantages to be had in the operation of all kinds of ordinary flashlights and lanterns when equipped with this improvement. Included herein is a detailed description of the nature of prior art shortcomings, together with particular description as to how my invention now functions to overcome these shortcomings.

I particularly teach the novel finding that considerable overall improvement in average light-producing operating efficiency is obtained through the use of my invention over the lifetime of an ordinary dry cell battery.

By way of example, using a Bright-Star model 2206 lantern (Bright-Star Industries, 600 Getty Ave., Clifton, N.J. 07013), I have obtained extended operation of the usual Ray-O-Vac type 466 battery that might be used with this lantern. By replacing the original type PR-13 lamp with a type PR-3 lamp and installing circuits in accord with this invention, I have obtained several times the previously attained lifetime of operation from the battery. What is even more central to the essence of my invention is that this extended performance is obtained with a "whiter", more bright appearing light throughout the life-time of the battery, until the battery is terminally exhausted to less than 67% of its original operating potential. I have demonstrated also that, while the PR-3 bulb is "rated" for about 25% less light-output than the original PR-13 this rating is of little practical significance because I can in fact produce more satisfactory aesthetic operational performance due to the more constant, whiter and more bright quality of the resulting light which is actually obtained throughout the lifetime of the associated battery.

I have continued to demonstrate my invention's methods and the resulting improvements through incorporating these new circuits into a Fulton model 618 lantern (Fulton Industries Inc., 135 East Linfoot St., Wauseon, Ohio 43567) and together with the installation of a type PR-3 lamp, I have again obtained a more constant level of bright light, together with several times the useful lifetime from the ordinary Ray-O-Vac type 416 battery that might be used with this lantern.

Brilliant operation has been obtained over a longer period of battery life using my invention, together with a Ray-O-Vac type K2-3 krypton lamp (equivalent to industry type KPR-3 or Eveready type K-3), and a Ray-O-Vac type 466 battery, in a Hipco model 860 lantern (Hipwell Manufacturing Co., 831 W. North Avenue, Pittsburg, Pa. 15233). I thus demonstrate that an unfaltering level of light equal to or better than that produced by a PR-13 lamp operating from a fresh battery is now obtainable throughout the full life expectancy of any common dry-cell battery.

Just mentioned is an important point in the understanding of the overall meaning of my invention. Although a PR-13 lamp (rated for 2 MSCP) produces about one-third more candlepowers of light as what the PR-3 lamp (rated for 1.5 MSCP) may produce, it is the subjective deterioration of the quality of light (and real light bulb efficiency) which in fact makes the apparent brightness of my invention's use of a PR-3 lamp to be usefully about equivalent to, or more often appear to be significantly better than, the light produced by a PR-13 lamp. Since the light produced by the PR-3 lamp remains achromatic throughout the full life-span of the battery, the light appears "brighter" and more "desirable", and for most practical purposes is more useful. On the other hand, since the light produced by the PR-13 bulb deteriorates in quality, quickly becoming "yellow" as the battery ages (together with a technical decrease in real lamp efficiency) the overall result of using a type PR-13 lamp is in reality more visually objectionable to the typical user.

I have also equipped other flashlights and lanterns, made by Ray-O-Vac Corp., Madison, Wis. 53703 and others, to benefit from my invention's improvements and to demonstrate the flexibility of the invention's approaches. In particular, my invention finds apparent utility with "heavy duty" flashlights (ordinarily using three or more "D" cells), and with lanterns using "D" cells or the usual type 416 or equivalent battery. Most importantly, my invention now affords not only much longer battery life, but considerably better quality of light from equipped flashlights and lanterns which is an immeasurable benefit to serious users of portable lights, such as emergency personnel, police, firemen, soldiers, and others having need of a good, reliable, bright source of light free of the here-to-fore frequent difficulties with "fading" or "yellowing" light quality and prematurely short useful battery life. With my invention, expensive premature battery changes become a thing of the past.

A fundamental issue which my invention overcomes is the matter of absolute efficiency of overall operation of a portable light. It is well established that common types of incandescent light bulbs have an operating efficiency on the order of 7%. This is to say that only about 7% of the energy consumed results in useful light, while the rest appears as heat (e.g., infra-red radiation). More to the point, a 7% efficiency is obtainable only when full rated voltage appears across the lamp. A mere 10% drop in lamp voltage can result in a 30% drop in the level of light produced, and a loss of overall lamp efficiency to about 5.8%. What is even more to the point of my invention is the underlying discovery that holding the overall efficiency of a lamp's operation up throughout the accepted useful life of a battery's discharge cycle more than offsets a small decrease in efficiency that might result from intrinsic losses attendant with my invention during initial full fresh battery voltage operation of the lamp. In other words, it is better to maintain lamp operation relatively even between 4.2% to 6.45% throughout a 33% drop in battery voltage (as is now taught by my invention) than what it is to have lamp operation deteriorate from about 7% to 3.2% during a comparable battery discharge. In my invention's description you will find further discussion of, together with graphical curves showing, this important to understand overall operational improvement now taught by my invention. More particularly, with my invention embodied in the usual lantern or flashlight, the actual light produced by the lamp will remain at substantially a 100% level throughout the 33% battery discharge (say, from 6 volts to about 4 volts), while all the previous lamps drop almost exponentially from 100% to only about 26% during the same 33% battery discharge rate. Significantly, my invention continues to produce bright "white" light over the full battery operation range, while existing lights quickly "yellow" and dim-down.

DESCRIPTION OF MY DRAWINGS

My invention is illustrated by 26 sheets of drawings showing 26 figures

FIG. 1—An elemental hookup for my invention.

Figure 2:
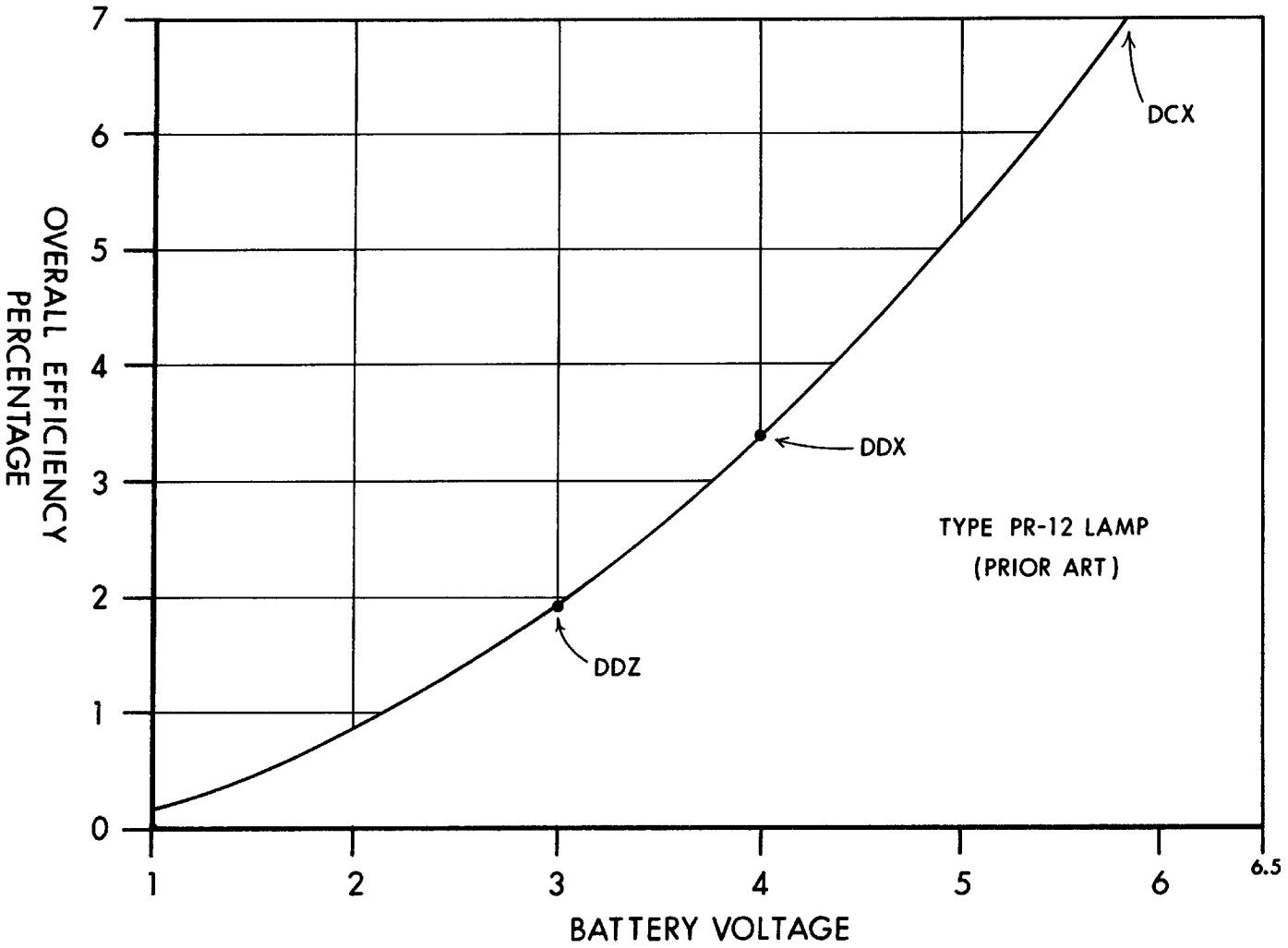

FIG. 2—Performance plot for a flashlight bulb in parallel with a battery.

FIG. 3—Light produced by a prior art lantern or flashlight compared with my invention.

Figure 4:
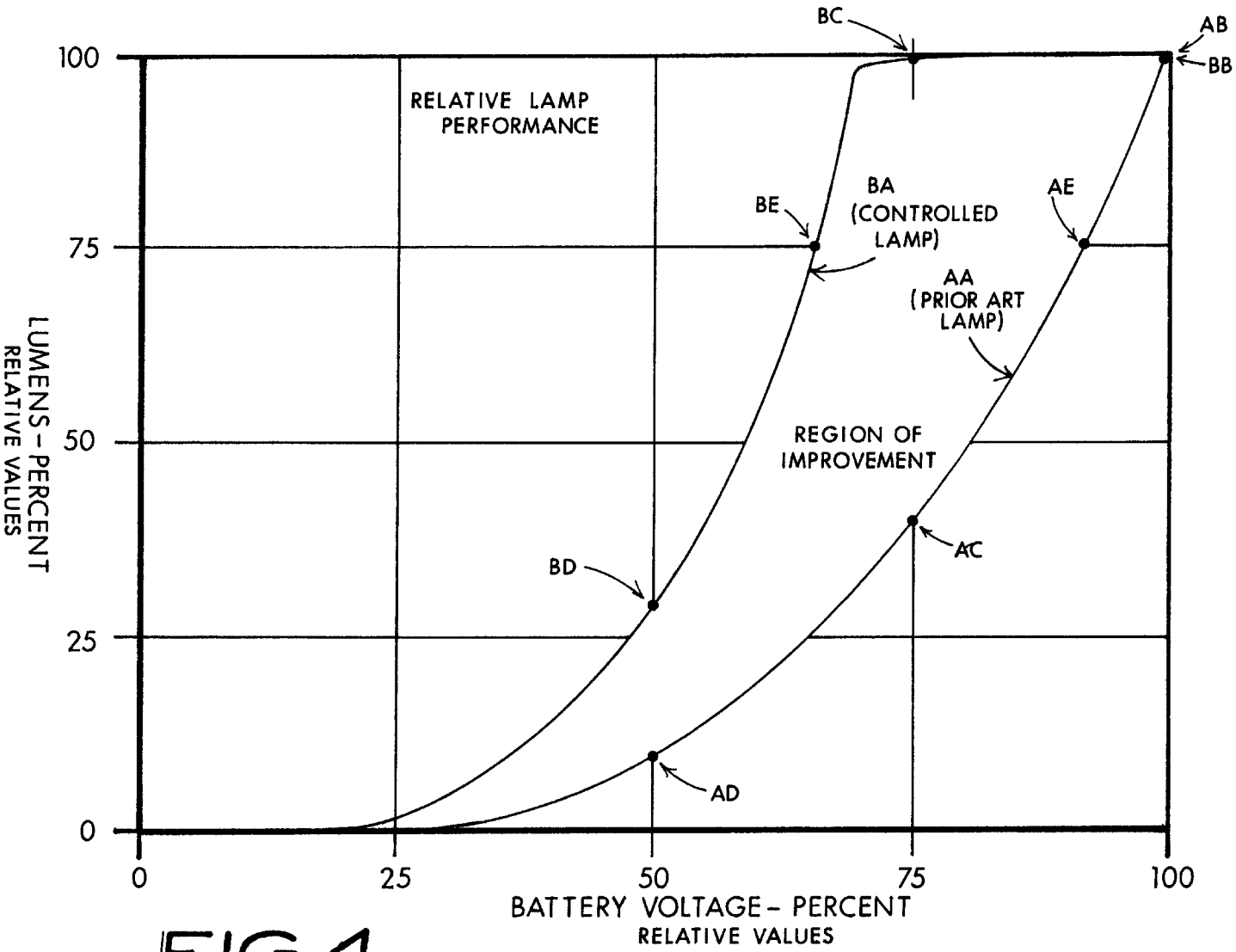

FIG. 4—Plot for uniformity of light produced by my invention compared with a prior art flashlight or lantern.

Figure 5:
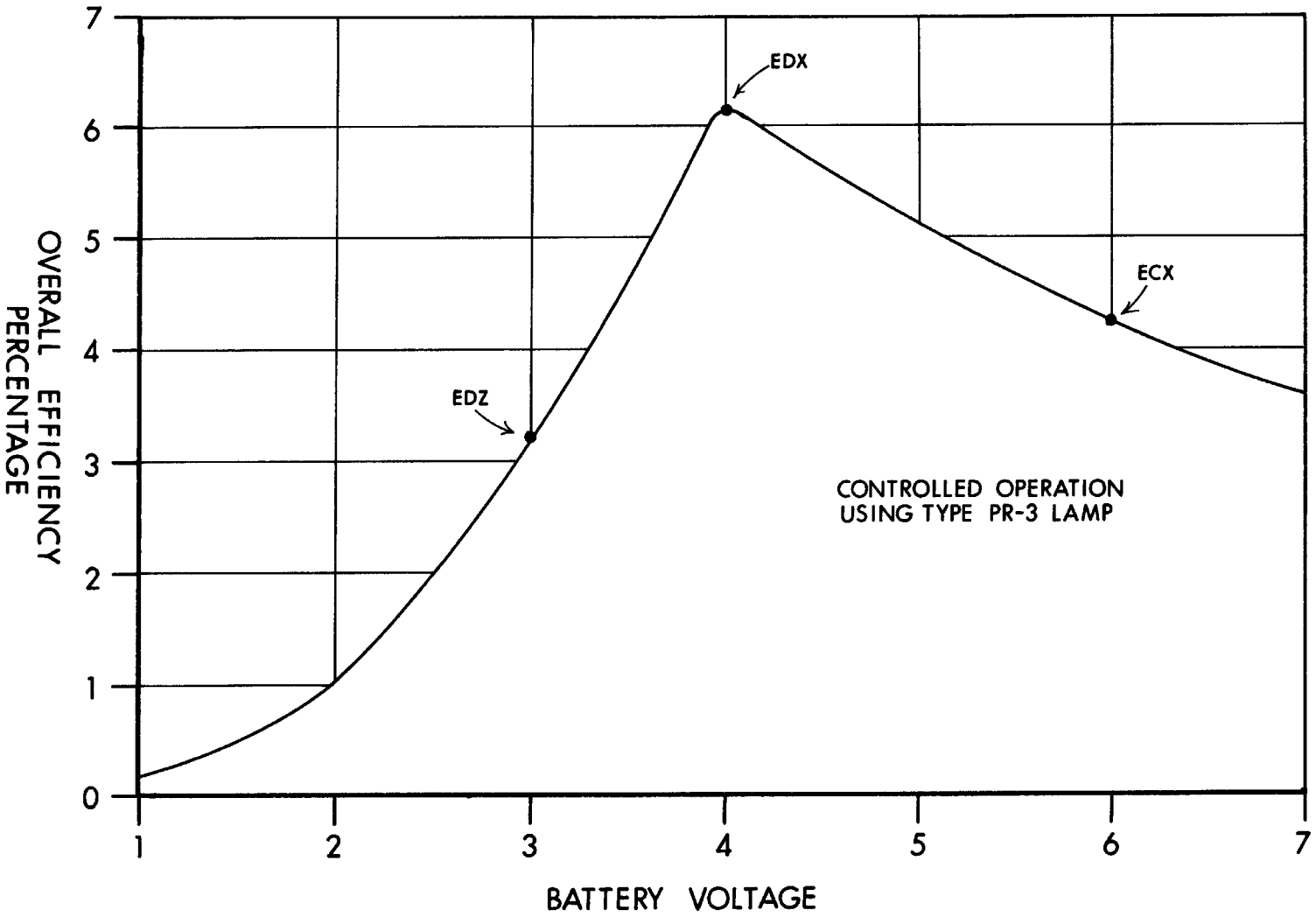

FIG. 5—Overall efficiency of a particular embodiment for my invention.

Figure 6:
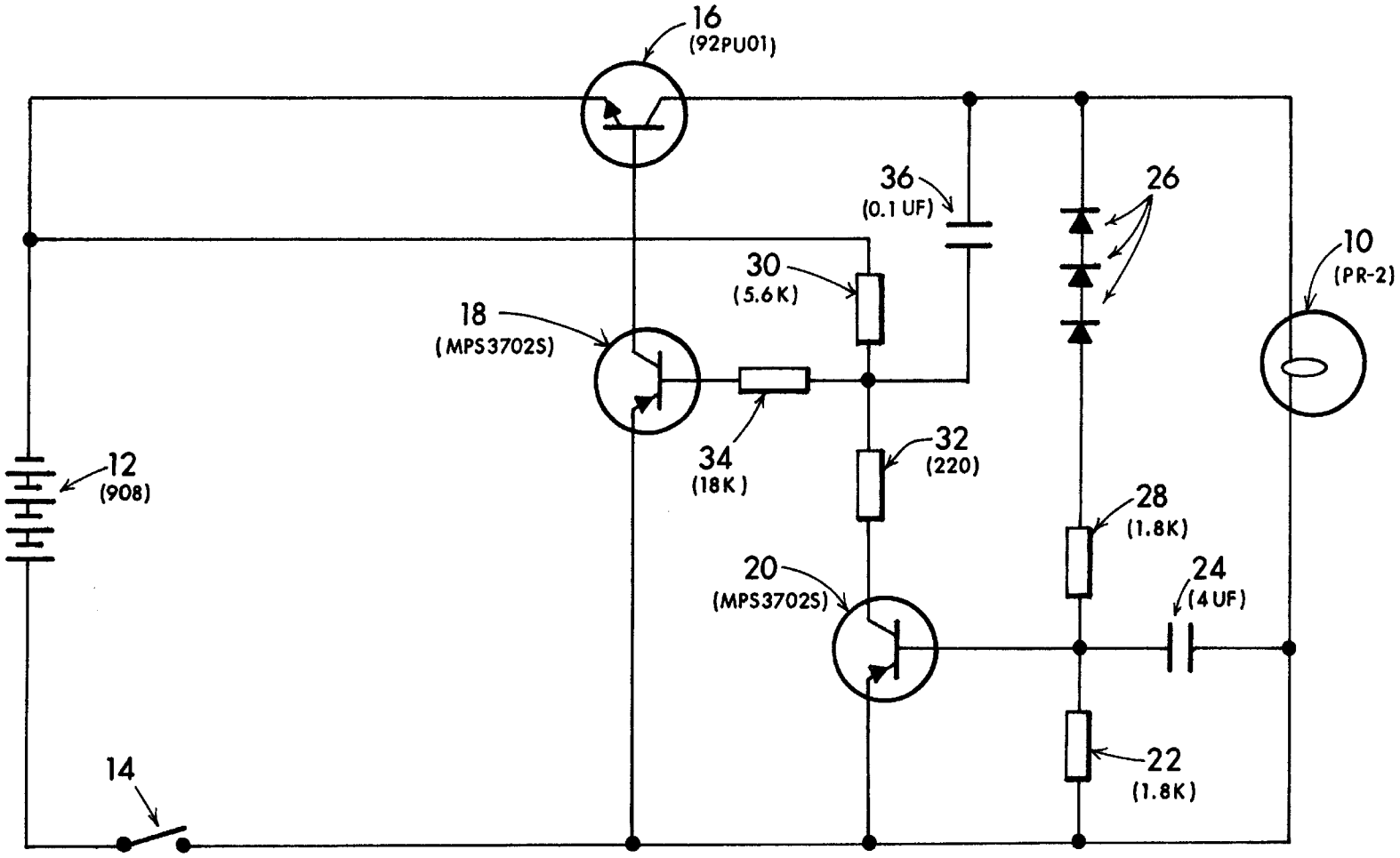
PRIOR ART FIG. 6

FIG. 6—Circuit for a PRIOR ART Invention.

Figure 7:
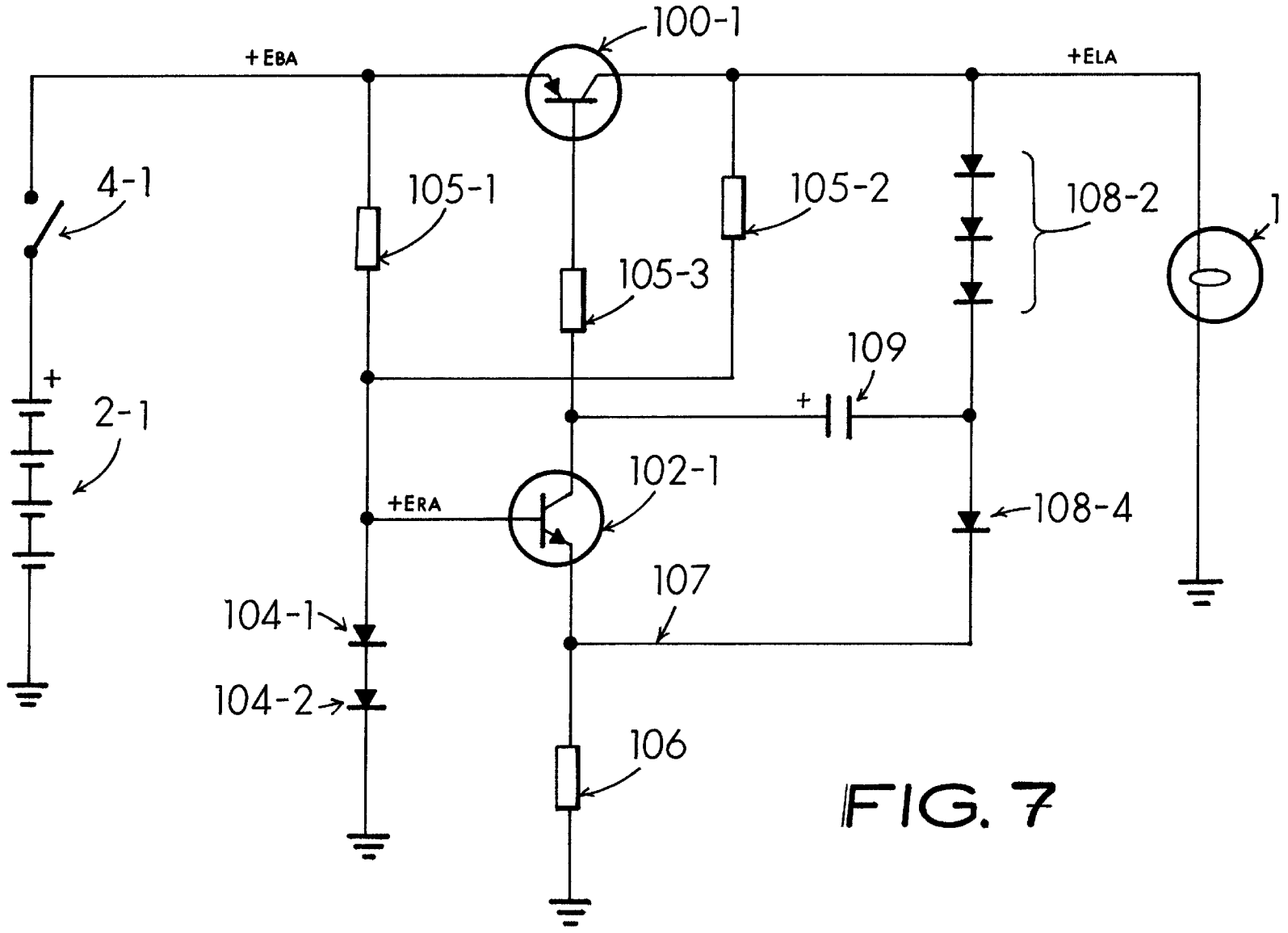

FIG. 7—A variant hookup for my invention.

Figure 8:
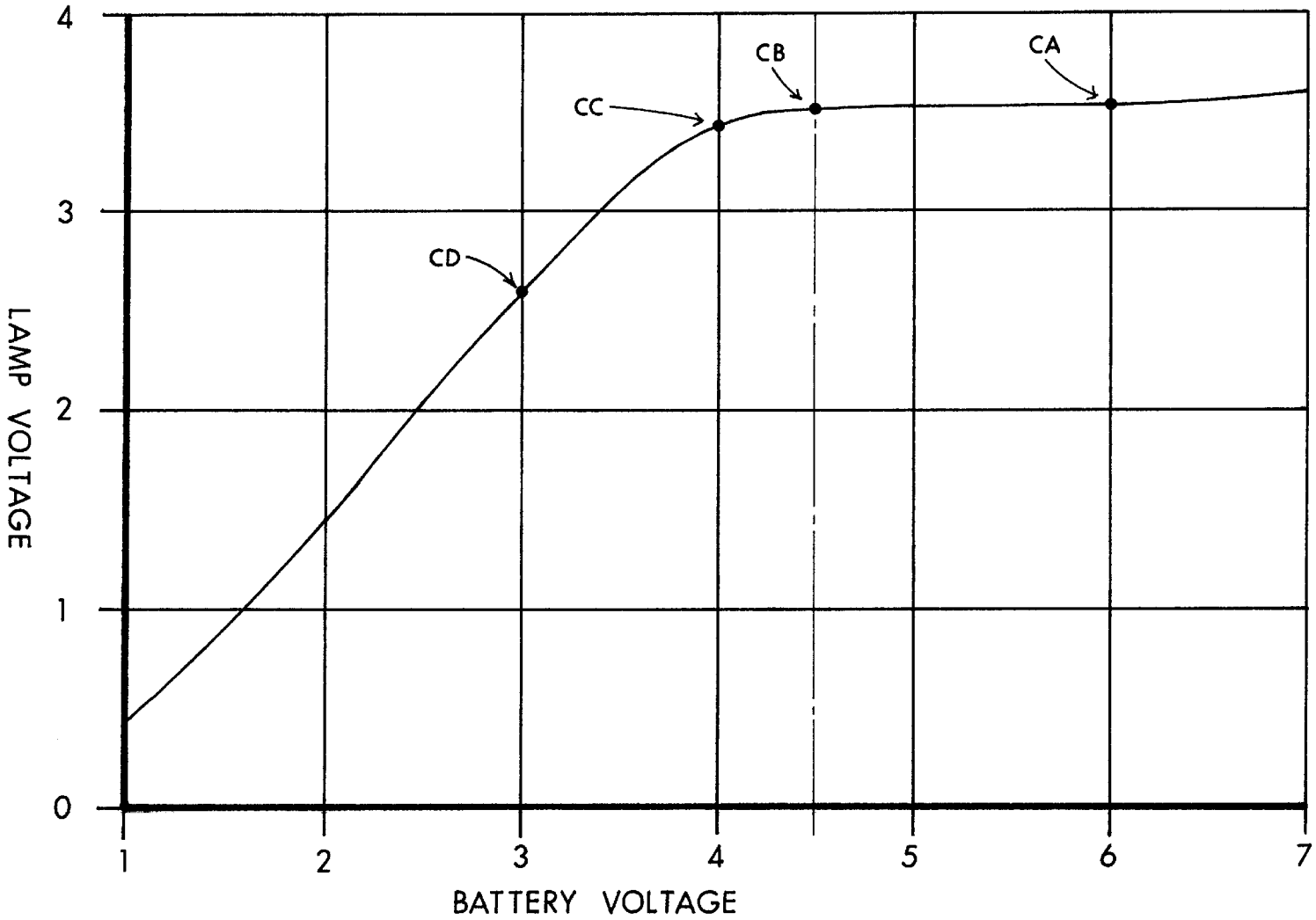

FIG. 8—Plot of lamp voltage relative with battery voltage using my invention of FIG. 1 or FIG. 6.

Figure 9:
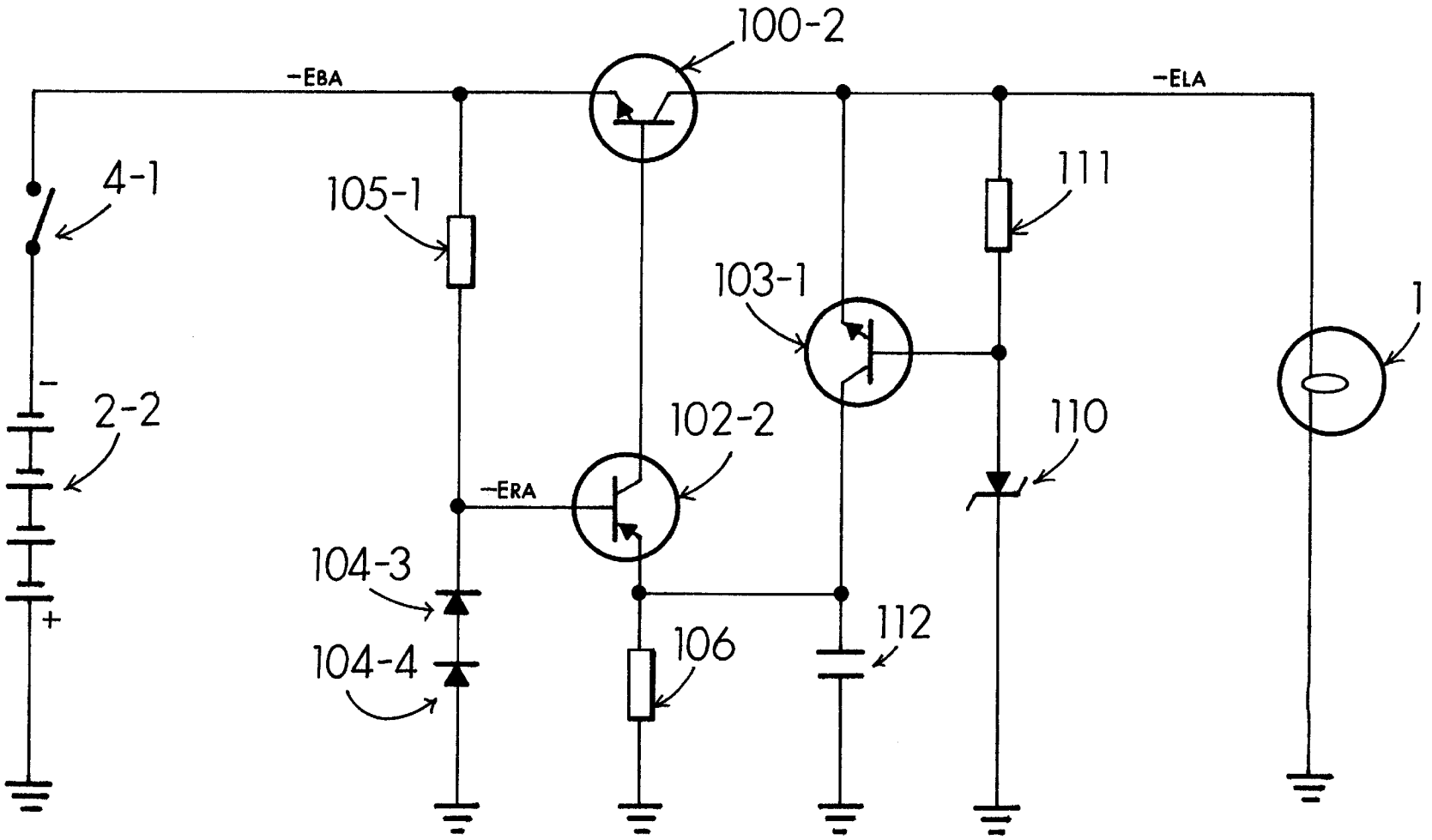

FIG. 9—Additional gain stage coupled with my invention.

Figure 10:
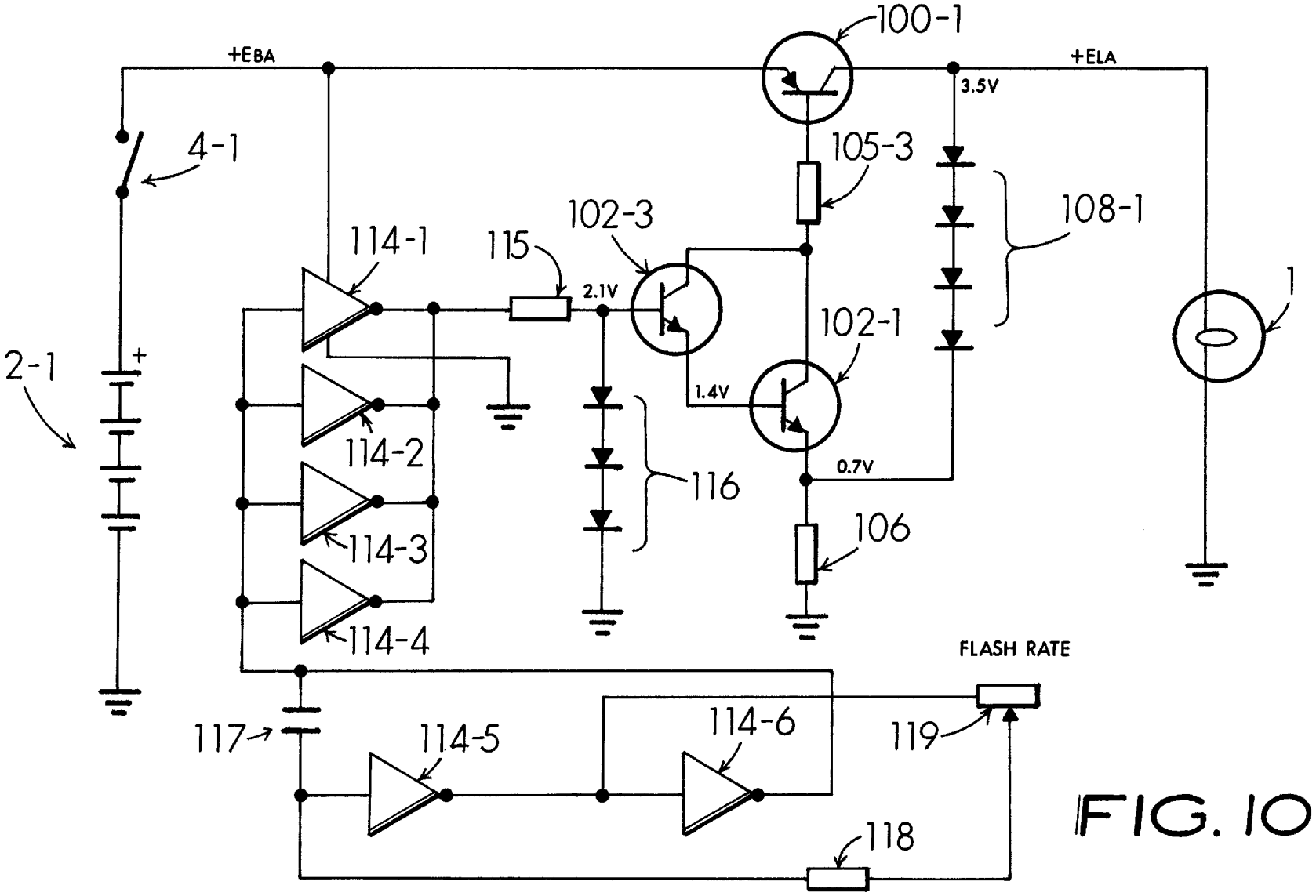

FIG. 10—Flashing light flashlight hookup.

Figure 11:
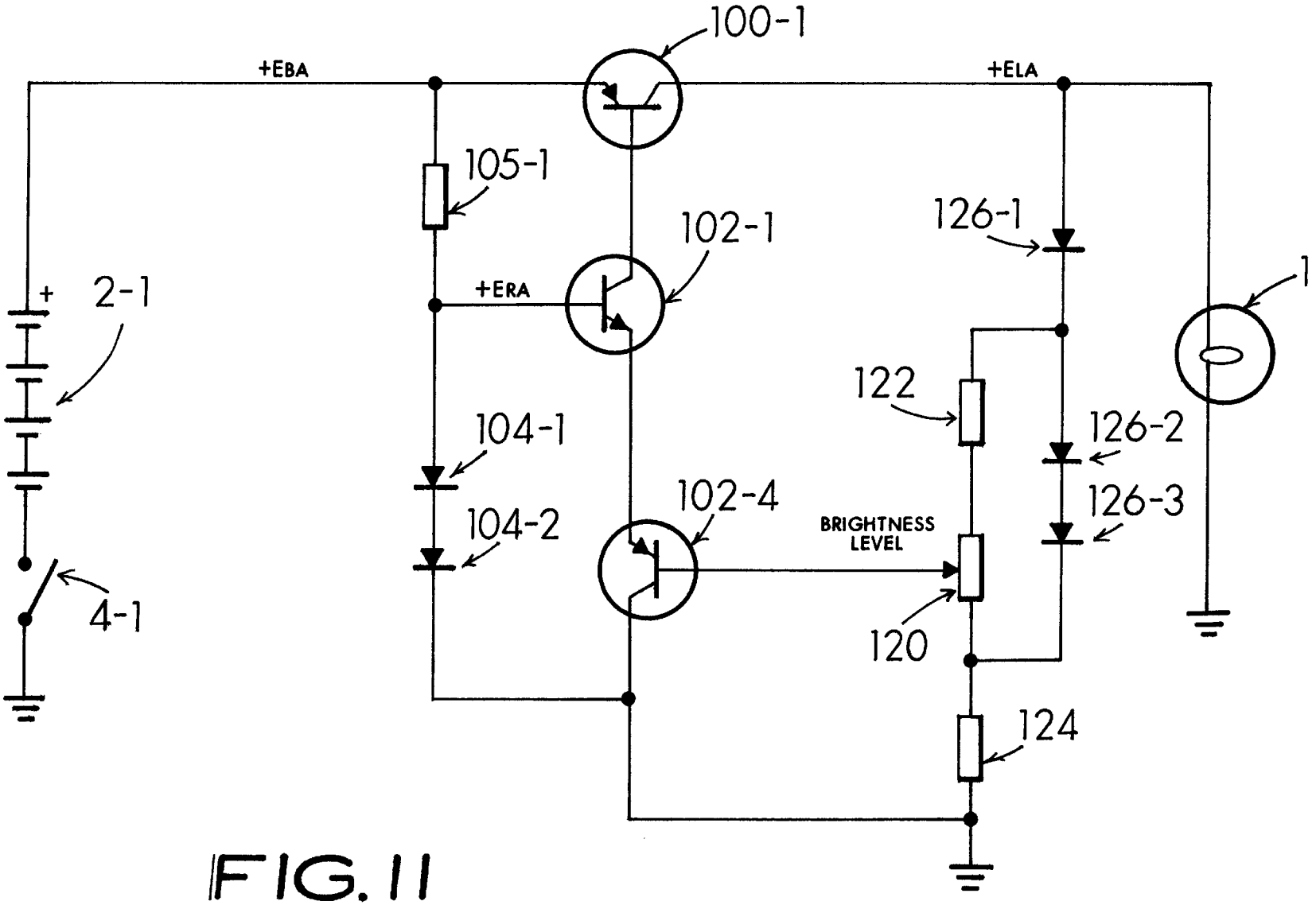

FIG. 11—Variable brightness lantern or flashlight.

Figure 12:
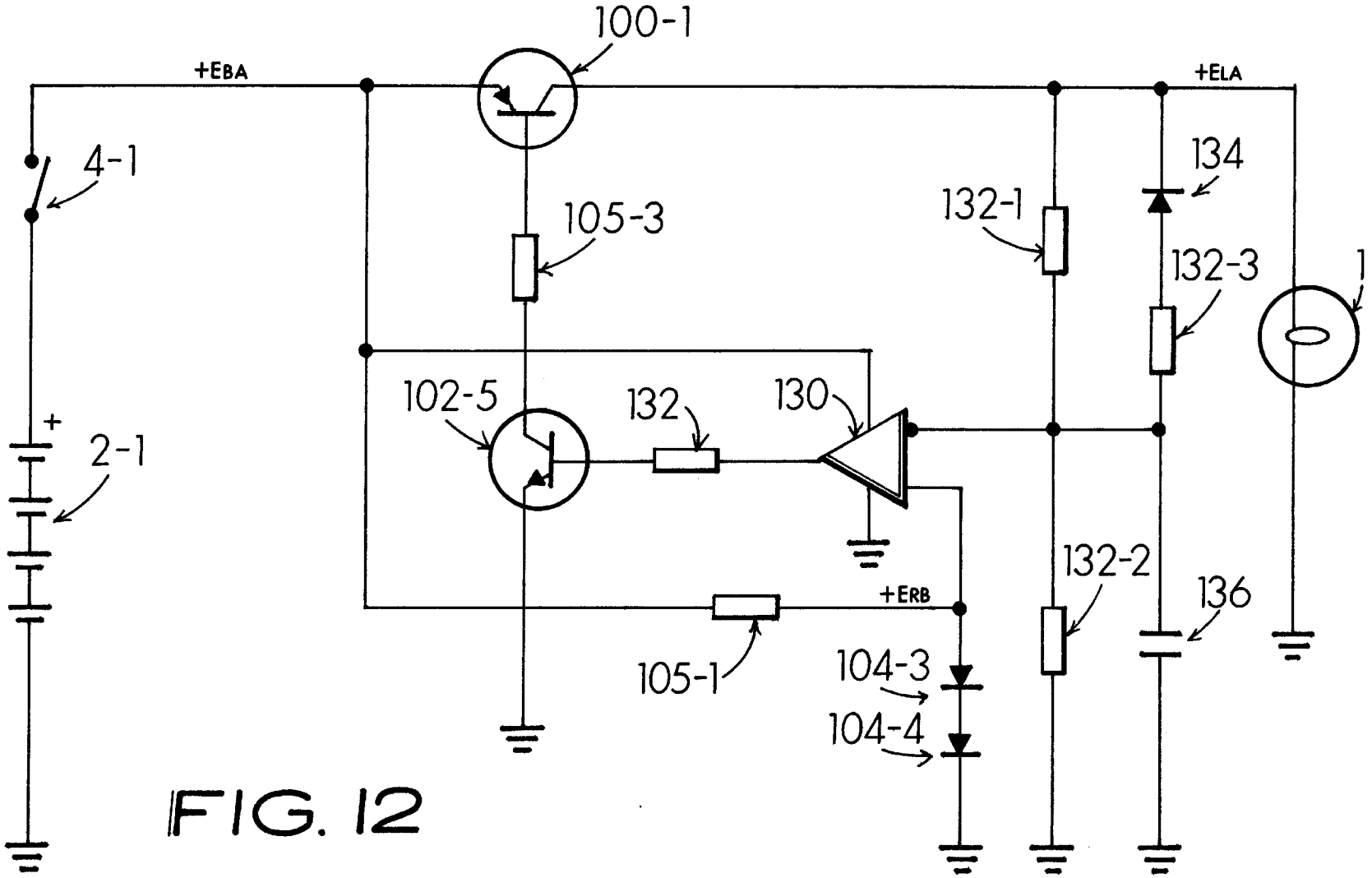

FIG. 12—A form for my invention whereby the lamp flashes on initially brighter than normal.

Figure 13:
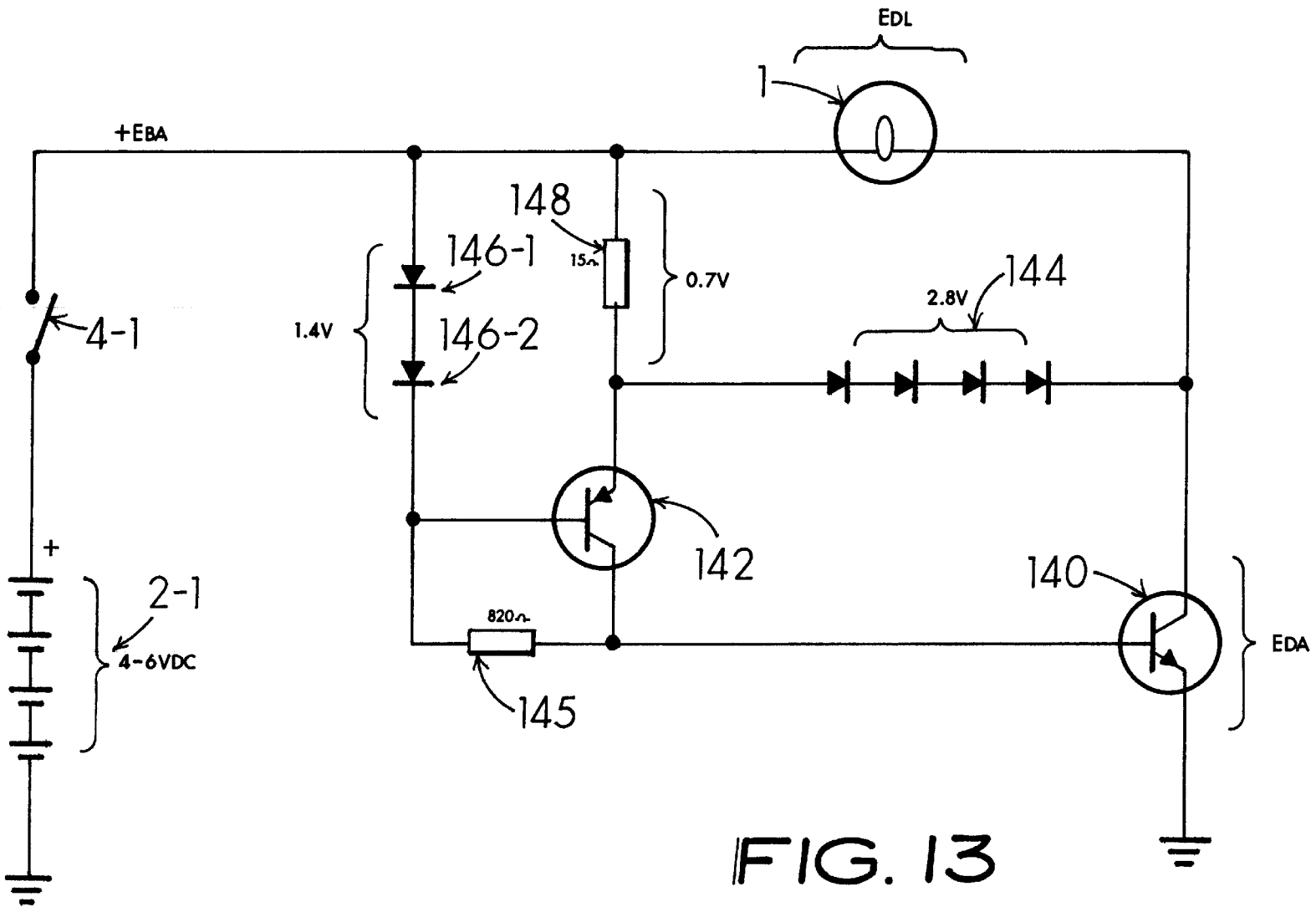

FIG. 13—Another variant form for my invention.

Figure 14:
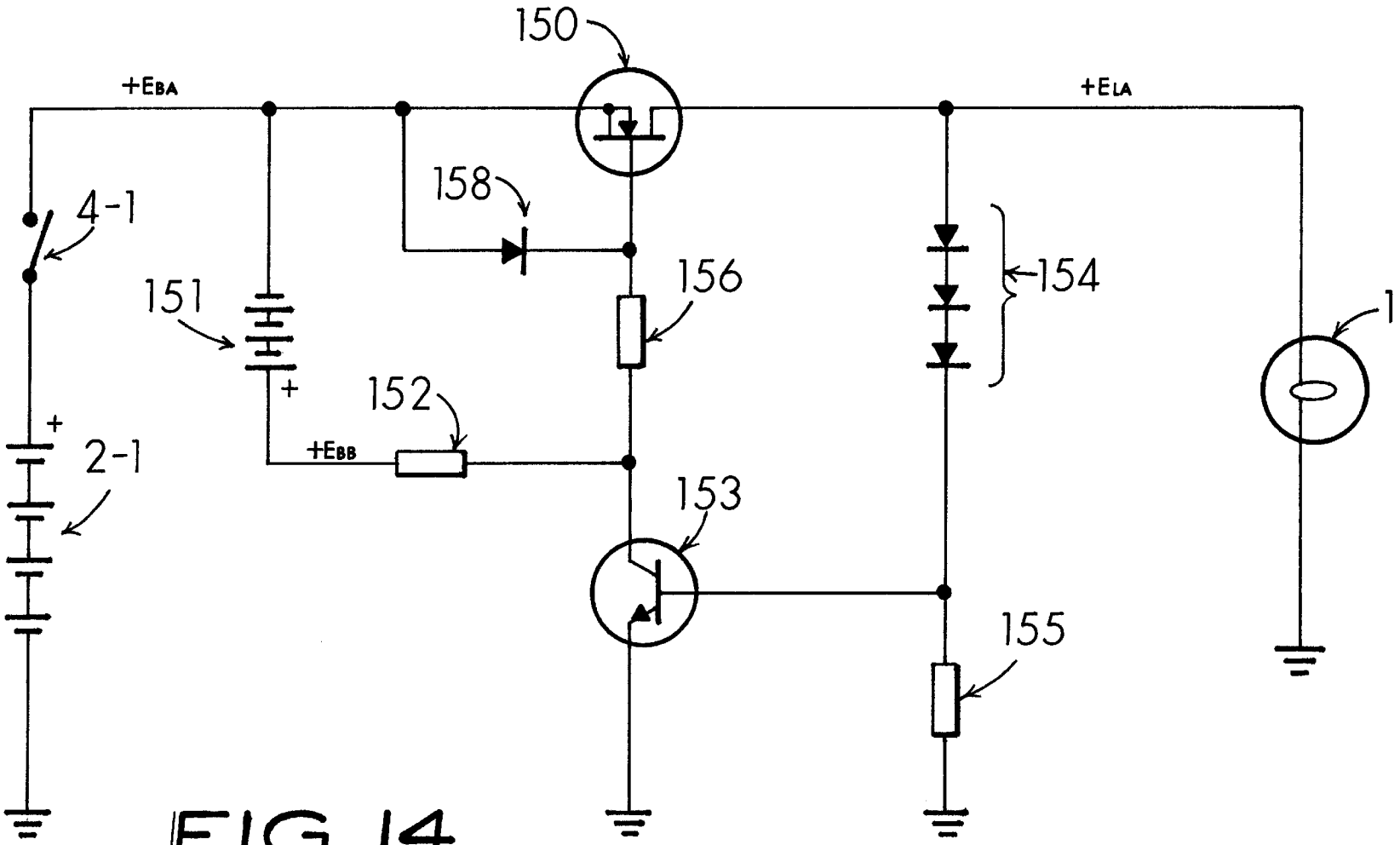

FIG. 14—An arrangement for my invention using a MOSFET impeder device.

Figure 15:
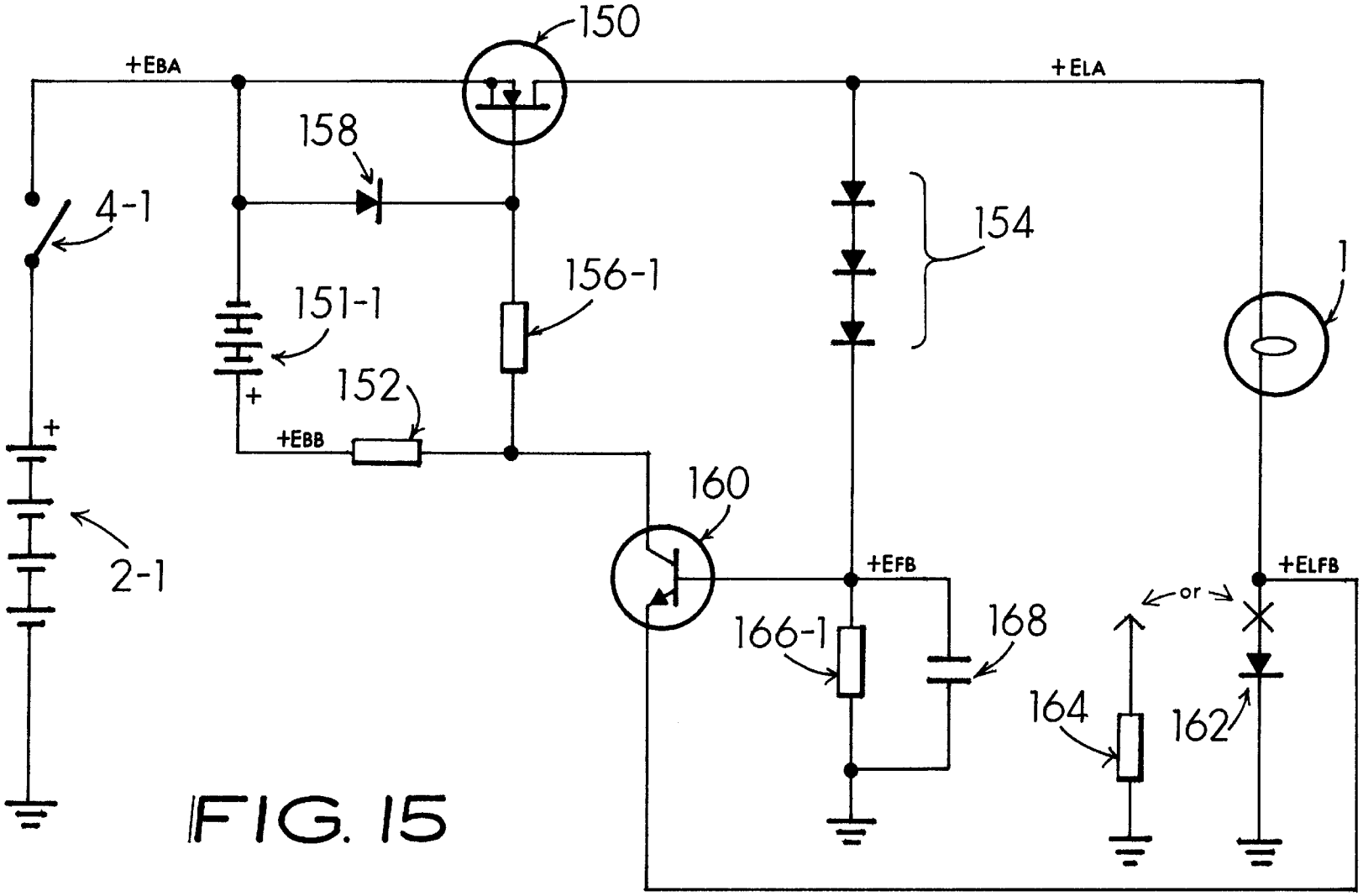

FIG. 15—A variation of my invention using the MOSFET impeder device.

Figure 16:
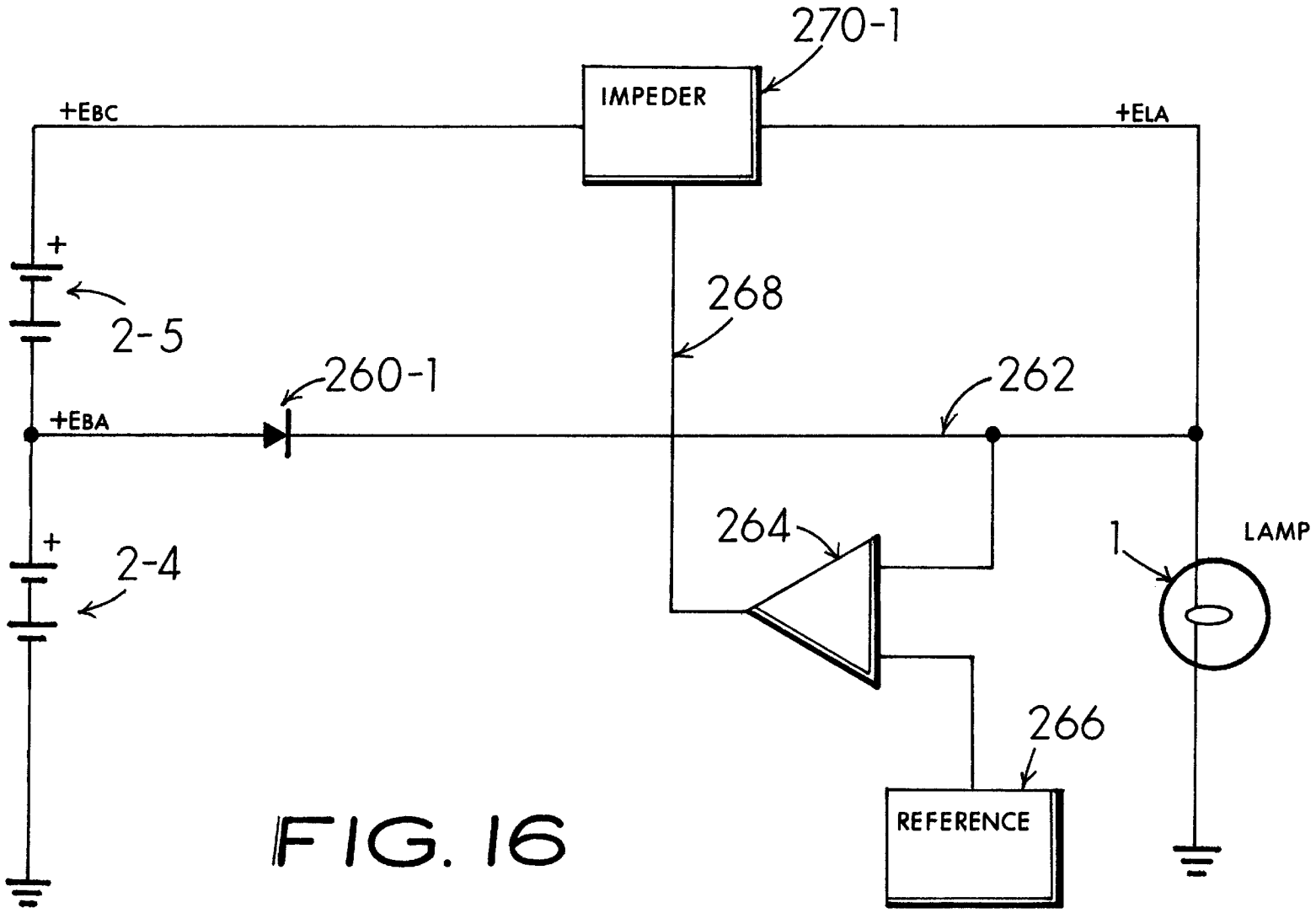

FIG. 16—An arrangement of dual batteries including serial coupling of the second battery to supplement the first battery during discharge.

Figure 17:
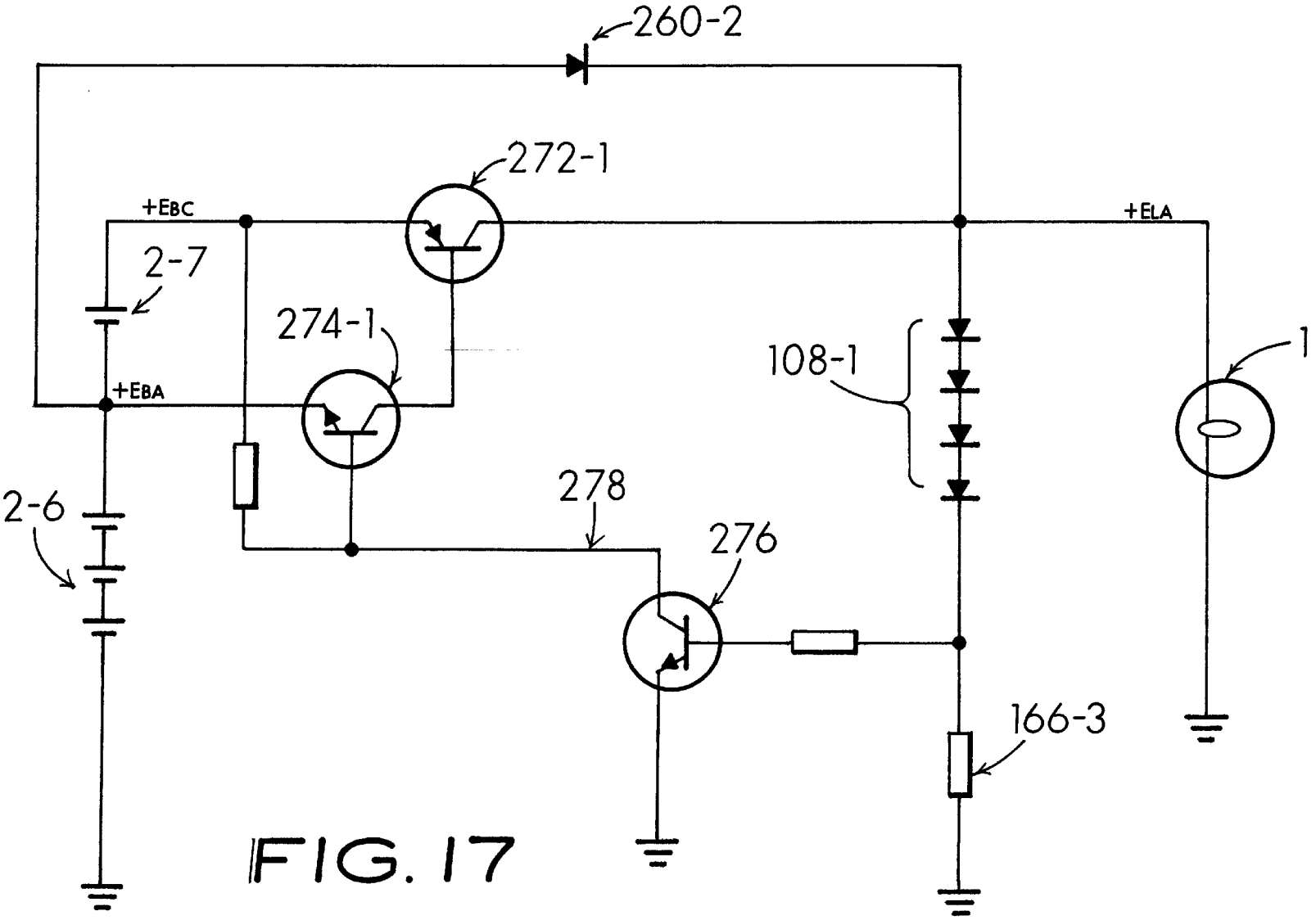

FIG. 17—Schematic for a serial dual battery controller.

Figure 18:
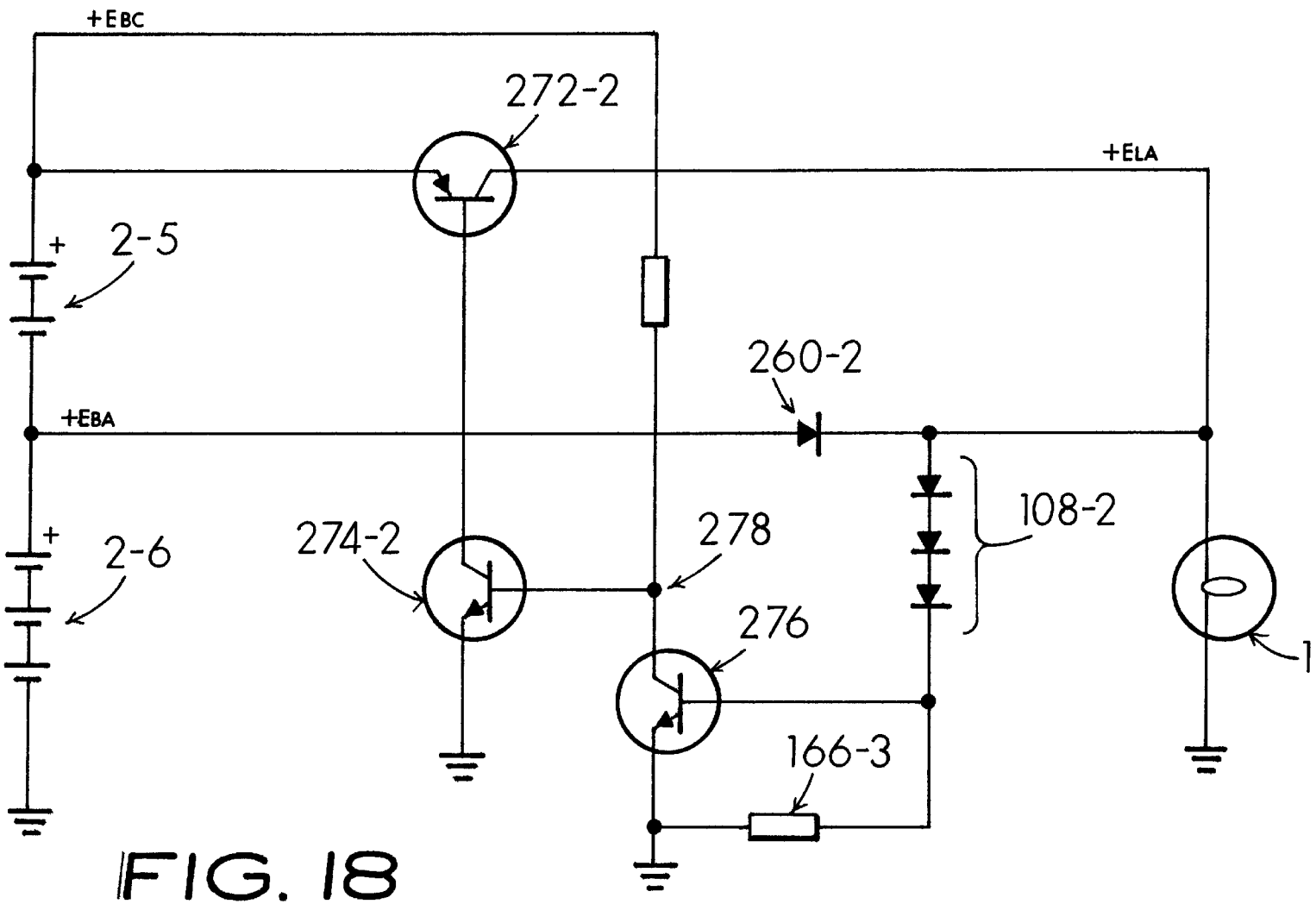

FIG. 18—A variant form of serial dual battery controller.

Figure 19:
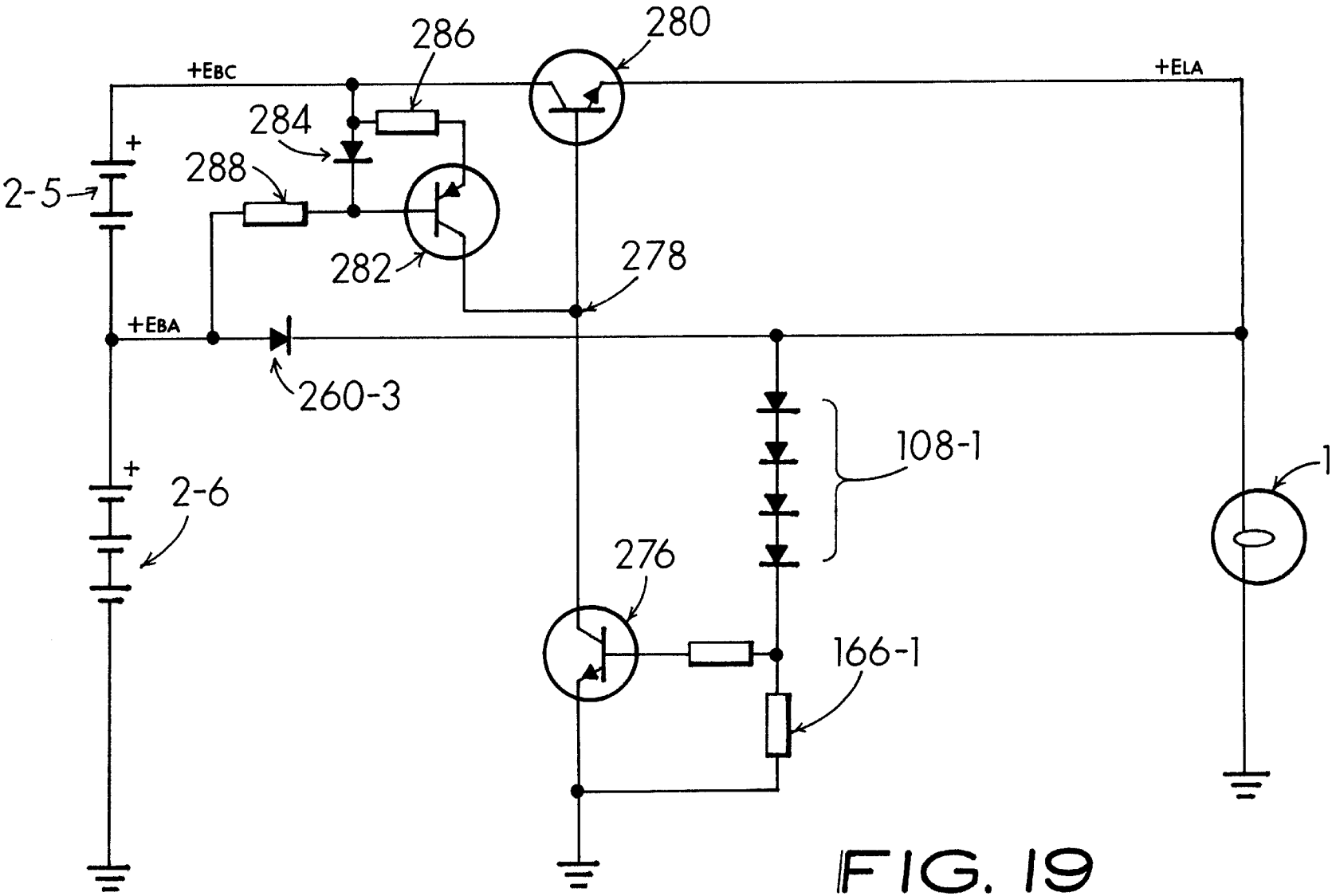

FIG. 19—Another variant form for my serial dual battery controller.

Figure 20:
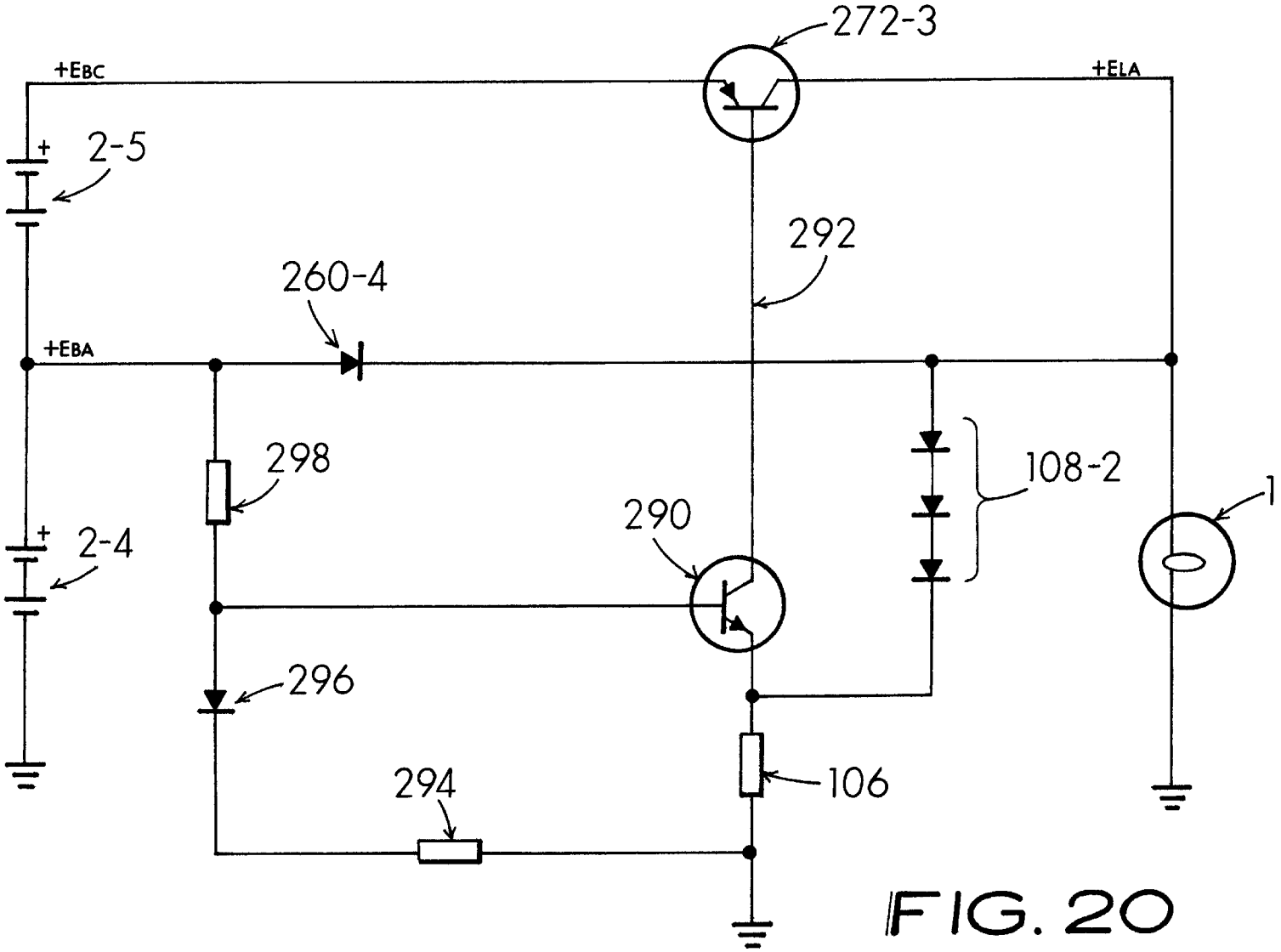

FIG. 20—A further arrangement of my serial dual battery controller.

Figure 21:
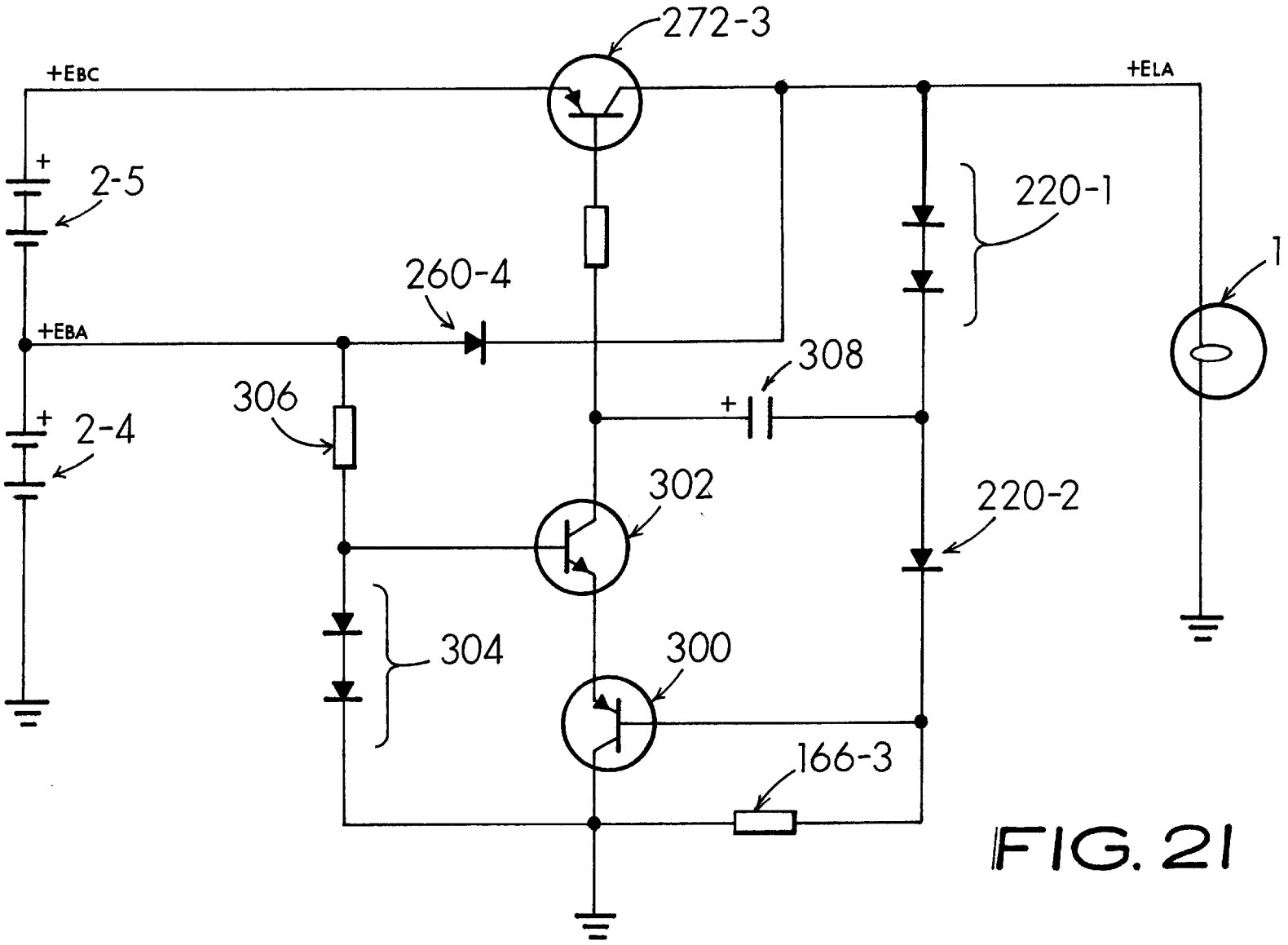

FIG. 21—Increased AC and DC gain for the controller portion of my serial dual battery controller.

Figure 22:
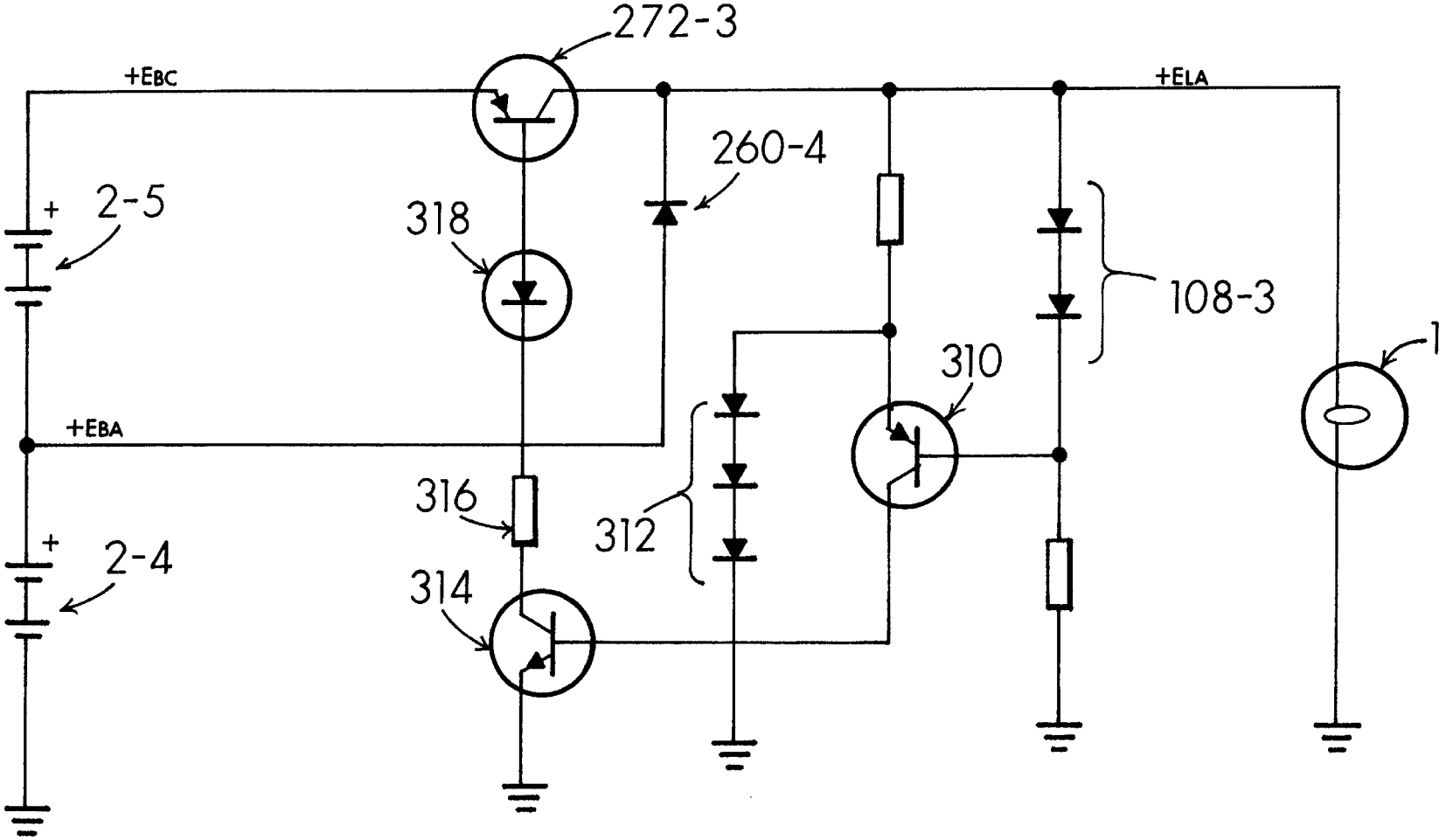

FIG. 22—An LED indicates battery deterioration or imminent battery replacement in this controller.

Figure 23:
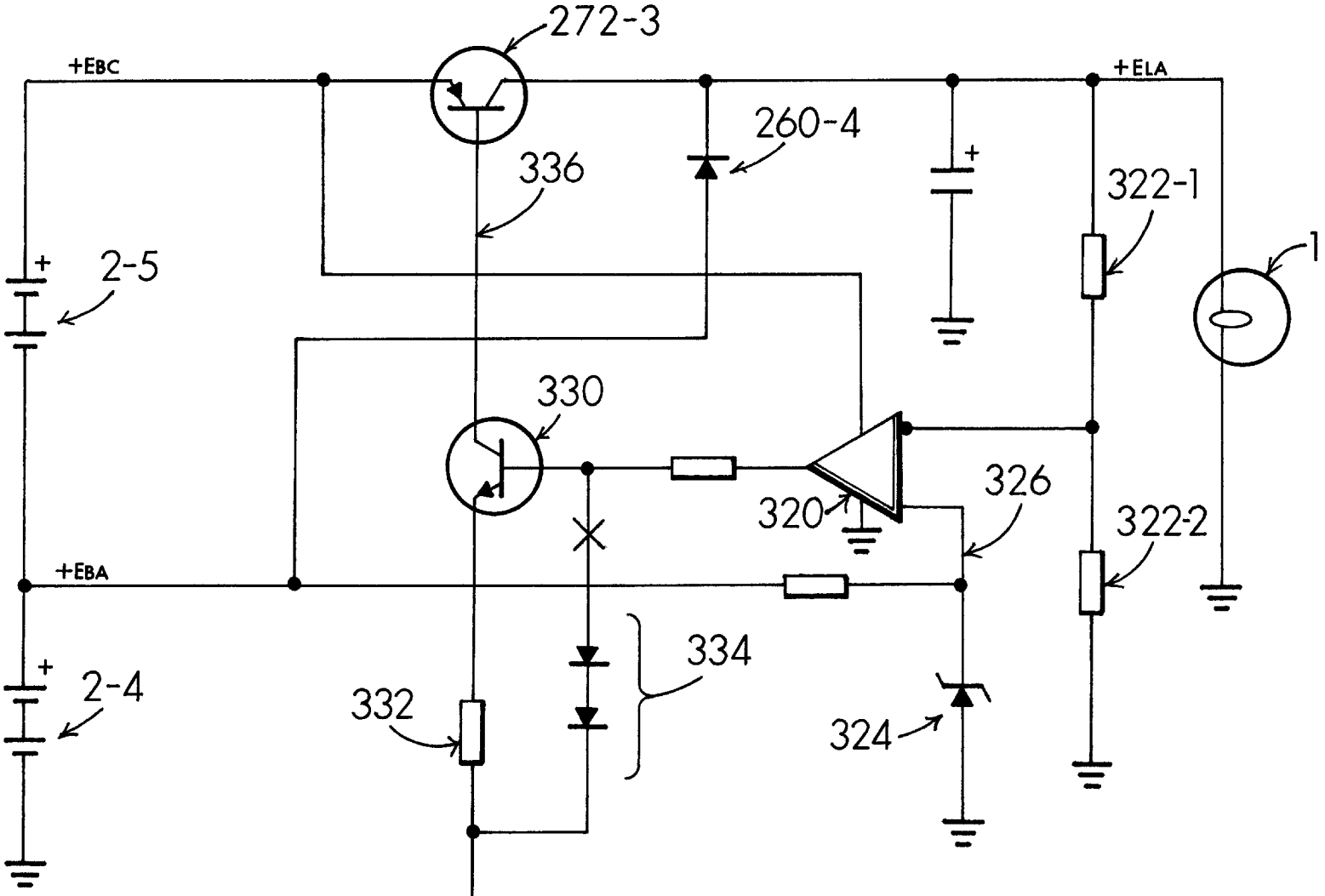

FIG. 23—Another variant form for my serial dual battery controller.

Figure 24:
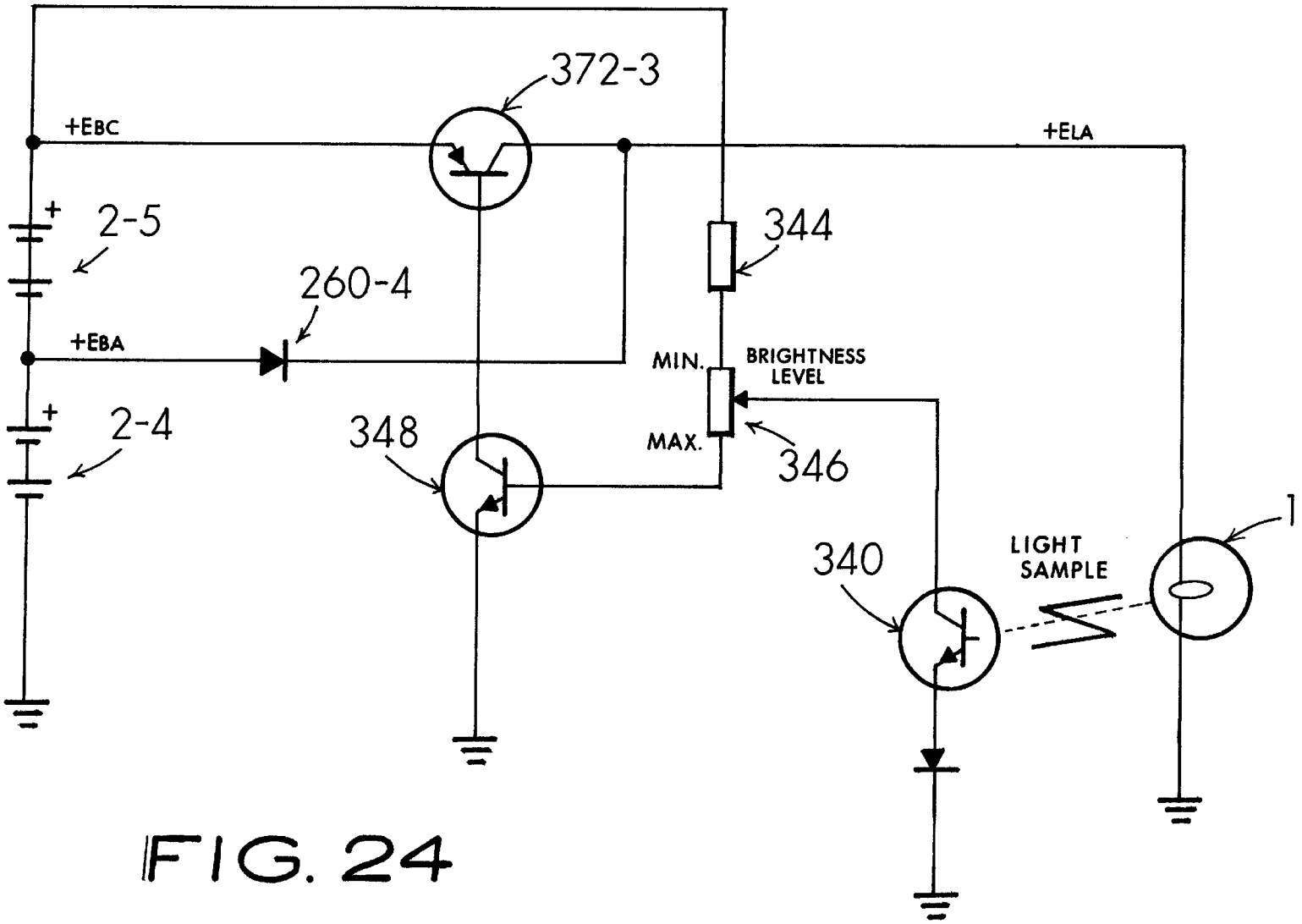

FIG. 24—Light sensor stabilization of a lamp is depicted for my invention's form of a dual battery controller.

Figure 25:
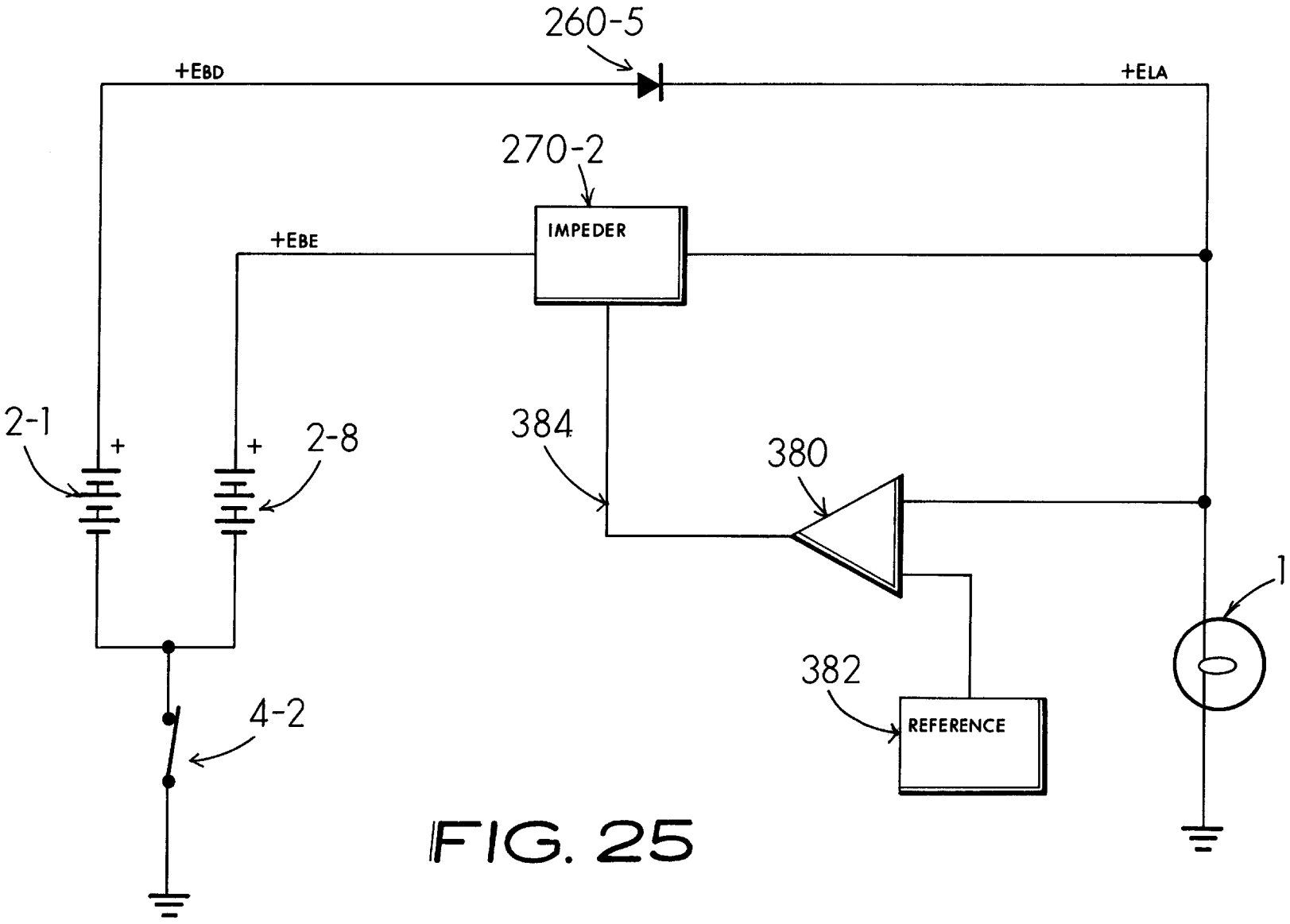

FIG. 25—Parallel dual battery control provides supplementary power from the second battery when the first battery becomes partly discharged.

Figure 26:
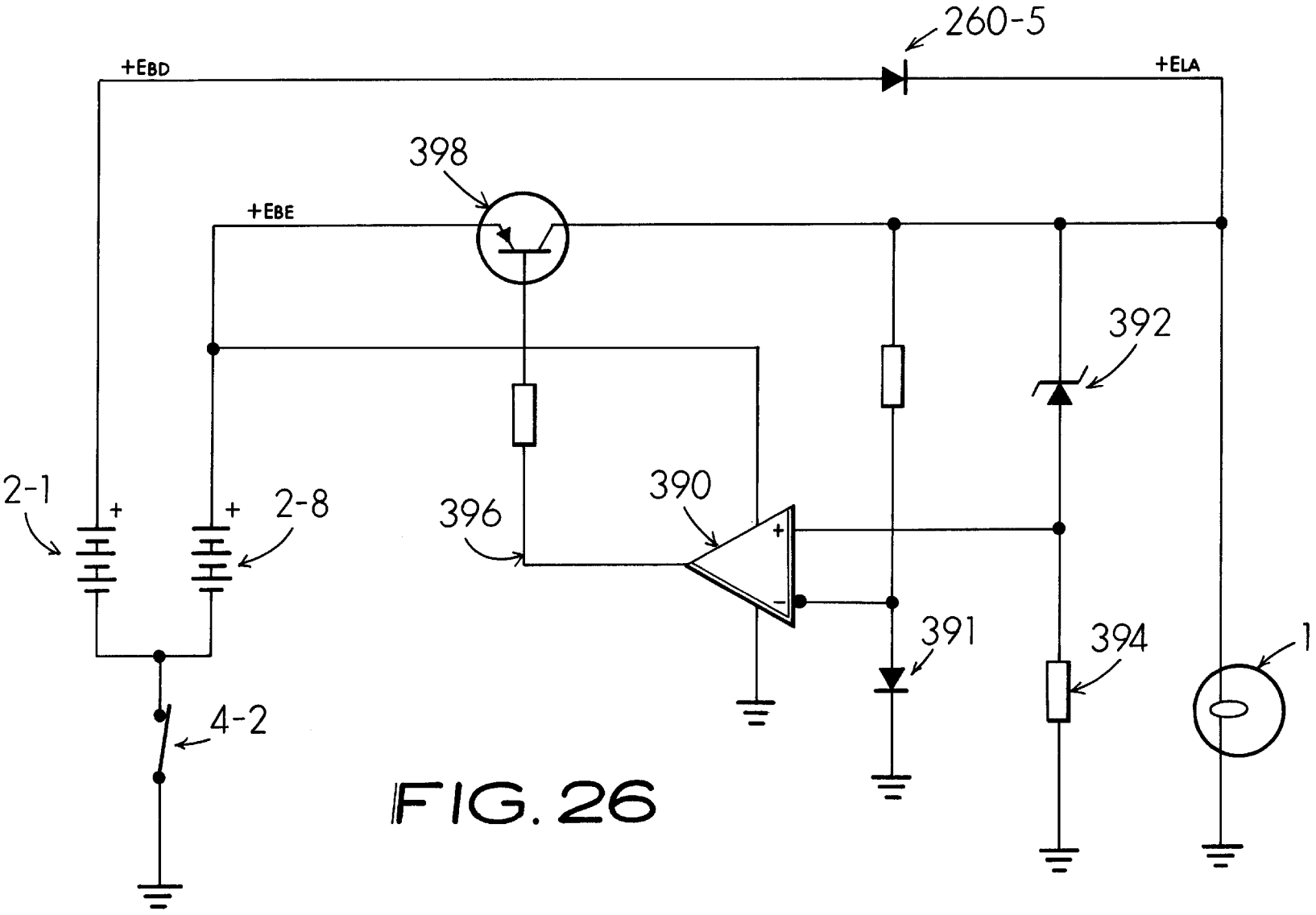

FIG. 26—An electrical hookup for my parallel dual battery control of lamp power.

DESCRIPTION OF MY INVENTION

My invention as shown in FIG. 1 to include a battery 2-1 comprising four dry cells coupled in series to produce about 6 volts when fresh. The battery couples through an "ON/OFF" switch 4-1 with line E(BA) and the emitter of a PNP power transistor 100-1. The collector line E(LA) of this transistor followingly couples with a small lamp 1, such as a type PR-3 incandescent flashlight bulb rated 3.57 volts, 0.5 ampere (1.79 watts). A smaller NPN transistor 102-1, such as a type 2N4124, along with two bias level setting diodes 104-1,104-2, a resistor 105-1 and an emitter resistor 106 act conjunctively as a source of constant current for the base of the power transistor 100-1. A characteristic of this hookup is for a voltage level to develop at juncture 107 about 0.7 volt which is the two junction drops of diodes 104-1,104-2 (e.g., about 1.4 volts) minus the base to emitter drop of the transistor 102-1 (e.g., about 0.7 volt). Ordinarily, the value of resistor 106 is selected to produce a current flow through the collector-emitter portion of transistor 102-1 and therefore through the base-emitter portion of power transistor 100-1 to fully saturate transistor 100-1, reducing its effective impedance to a very low value and coupling a maximum flow of current between the battery 2-1 and the lamp 1. An immediate effect of this condition is for the voltage on line E(LA) to attempt to rise to the battery level, say 6 volts. However, once the voltage on line E(LA) rises to a value sufficient to overcome the four forward junction drops of diodes 108 plus the voltage drop across resistor 106, additional current is introduced through the resistor 106 which subtracts from the current which might otherwise flow through the transistor 102-1. As a result, the base current of the power transistor 100-1 is reduced, increasing its impedance to a point where a voltage drop develops across the power transistor 100-1 having a value which is about the difference between the battery 2-1 terminal voltage and the desired lamp 1 voltage. With the shown components arranged in the example hookup, about 3.5 to 3.7 volts develops on line $E_{LA}$ over a range of battery voltages between about 4.4 volts and at least 6 volts. I have found the overall operating efficiency of this circuit may be maintained relatively high through the use of common components having relatively wide tolerance spreads, particularly in regard to the beta of transistors 100-1,102-1. The following table typifies the performance which may be obtained:

TABLE I

| BATTERY | TRANSISTOR 100-1 | CIRCUIT EFFICIENCY | |
|---|---|---|---|
| VOLTAGE | VOLTAGE DROP | NET | ACTUAL |
| 6.0 | 2.43 | 60% | 55% |
| 5.5 | 1.93 | 65% | 61% |
| 5.0 | 1.43 | 71% | 66% |
| 4.5 | 0.93 | 79% | 74% |
| 4.0 | 0.43 | 89% | 85% |

LAMP is PR-3, 3.57 V, 0.5 A.
TRANSISTOR 100-1 Beta at least 20
NET efficiency includes only transistor 100-1 loss
ACTUAL efficiency includes overall circuit operation In FIG. 2 I represent the behaviour of a common type PR-12 incandescent flashlight lamp in an uncontrolled arrangement, simply hooked in parallel with a battery. The BATTERY VOLTAGE is provided by a typical NEDA type 906 or 915 (Ray-O-Vac type 941 or 942) lantern battery which initially provides about 6 volts DC. Lamp efficiency is said to be a little better than 7% with 6 volts applied to the lamp (remembering that the PR-12 is rated for 5.95 volts) at point DCX on the plot. When the battery voltage drops to about ⅔ (e.g., 4 volts) the point DDX shows that overall lamp efficiency has about halved, dropping to about 3.4%. When the battery voltage drops to 50% (e.g., 3 volts) the point DDZ shows lamp efficiency to have dropped below 2%. What does not appear on the plot is the subjective degradation of the light quality, appearing as a "yellowing" of the light which makes it appear even more dim and unsatisfactory to the eye. Measurements have also shown that the small flashlight size incandescent bulbs do not follow exactly the same performance curve as well known for larger sizes of incandescent bulbs. It is believed that, in part, this is due to disproportional thermal dissipation because the filament support structure for a small filament is relatively large relative with the support structure in a larger bulb. This is to say, the supporting wire framework for the filament in a small bulb is constructed from nearly the same gauge wire as used in a larger light bulb.

A computer program may be used to determine the operating characteristics for a variety of other common types of flashlight bulbs. The program appears for your convenience in overviewing my invention:

```
10  REM PERFORMANCE CHARACTERIZATION PROGRAM              PERFORM1.BAS
20  REM BASIC-80 Syntax - Compiled on DEC VT-180   (c) H.Weber 4/7/90 K1VTW
30  REM ==============================================================
40  GOSUB 1340                                        REM Ver. 1.02 10/12/94
50  PRINT CLS$+HOM$;
60  PRINT "BATTERY AND LAMP PERFORMANCE CHARACTERIZATION"
70  PRINT LF$+"ENTER>        Battery VOLTAGE ";
80  INPUT BV$
90  BVX=VAL(BV$)
100       IF BVX<1.5 OR BVX>9 THEN 70
110 PRINT LF$+"BULB CATEGORY"
120 PRINT "      1. Standard Incandescent"
130 PRINT "      2. Krypton Incandescent"
```

-continued

```
140 PRINT TAB(40);"ENTER>          Bulb Category 1–3 ";
150 INPUT BC
160       IF BC<1 OR BC>2 OR (BC/INT(BC)<>BC/BC) THEN 140
170       IF BC=2 THEN 490
180 PRINT CLS$+HOM$+LF$
190 CK=3.51:CN=1.58:CG=.541:LEF=.07          REM Standard Constants
200 PRINT "    STANDARD LAMP Category"+LF$
210 PRINT "       Choose lamp type:"
220 PRINT LF$+"     1.   Type    222    2.25V"
230 PRINT "     2.   Type    PR-2    2.38V"
240 PRINT "     3.   Type    PR-3    3.57V"
250 PRINT "     4.   Type    PR-4    2.33V"
260 PRINT "     5.   Type    PR-5    2.35V"
270 PRINT "     6.   Type    PR-6    2.47V"
280 PRINT "     7.   Type    PR-7    3.70V"
290 PRINT "     8.   Type    PR-12   5.95V"
300 PRINT "     9.   Type    PR-13   4.75V"
310 PRINT "    10.   Type    PR-18   7.20V"
320 PRINT "    11.   Type    PR-20   8.63V"
330 PRINT LF$+"       0.   Other Type - Enter Voltage"+LF$
340 PRINT TAB(40);"ENTER>          Selection 1–11 or 0 ";
350 INPUT LTA
360       IF LTA<0 OR.LTA>11 THEN 340
370       IF LTA=1 THEN LVX=2.25:PRX$="222"
380       IF LTA=2 THEN LVX=2.38:PRX$="PR-2"
390       IF LTA=3 THEN LVX=3.57:PRX$="PR-3"
400       IF LTA=4 THEN LVX=2.33:PRX$="PR-4"
410       IF LTA=5 THEN LVX=2.35:PRX$="PR-5"
420       IF LTA=6 THEN LVX=2.47:PRX$="PR-6"
430       IF LTA=7 THEN LVX=3.7:PRX$="PR-7"
440       IF LTA=8 THEN LVX=5.95:PRX$="PR-12"
450       IF LTA=9 THEN LVX=4.75:PRX$="PR-13"
460       IF LTA=10 THEN LVX=7.2:PRX$="PR-18"
470       IF LTA=11 THEN LVX=8.63:PRX$="PR-20"
480       IF LTA>0 THEN 650 ELSE 610
490 CK=2.86:CN=1.29:CG=.441:LEF=.09          REM Krypton constants
500 PRINT LF$+"    1.   Type    K1-2    (Rayovac Krypton)
510 PRINT "       2.   Type    K3-2    (Rayovac Krypton)
520 PRINT "       3.   Type    KPR-103 (Phillips)
530 PRINT LF$+"       0.   Other Type - Enter Voltage"
540 PRINT TAB(40);"ENTER>       SELECTION 1–3 OR 0 ";
550 INPUT LTB
560       IF LTB<0 OR LTB>3 THEN 540
570       IF LTB=1 THEN LVX=2.33:PRX$="K1-2/KPR-4"
580       IF LTB=2 THEN LVX=3.57:PRX$="K3-2/KPR-3"
590       IF LTB=3 THEN LVX=3.57:PRX$="KPR-103"
600       IF LTB>0 THEN 650 ELSE 610
610 PRINT TAB(40);"ENTER>          Lamp VOLTAGE ";
620 INPUT LV$
630 LVX=VAL(LV$)
640       IF LVX>(BVX-TJD) OR BVX<1 THEN 610
650 PRINT LF$+LF$+CLS$+HOM$+LF$+LF$
660 PRINT "ENTER>>   Transistor Switch Voltage Drop (.05 to 1.5 Volt)"
670 PRINT TAB(13);"(if NO ENTRY then 0.32 volt will be used)";
680 PRINT TAB(62);"";:INPUT TJD
690       IF (TJD>0 AND TJD<.05) OR TJD>1.5 THEN 660
700       IF TJD=0 THEN TJD=.32
710 PRINT LF$+"Do You Want PRINTOUT ?    Y/N ";
720 INPUT YN$
730       IF YN$="Y" OR YN$="y" THEN FL=1 ELSE FL=0
740 PRINT CLS$+HOM$;
750 PRINT SXB$
760 BX=BVX/.1:LX=LVX/.1:DX=BX–LX:EX=DX–70:BDX=BVX
770       IF LTA<1 AND LTB<1 AND LTC<1 THEN PRINT:PRINT:GOTO 790
780 PRINT " Lamp Bulb = ";PRX$;" =";LVX;"volts. ";:GOTO 800
790 PRINT " Lamp =";LVX;"volts. ";
800 PRINT "Battery =";BVX;"volts. Voltage Drop =";TJD
810 PRINT BAR$
820 PRINT " BATTERY LEVEL";
830 PRINT TAB(22);"LAMP VOLTAGE";:PRINT TAB(40);"LIGHT";
840 PRINT TAB(52);"LUMENS/WATT";:PRINT TAB(70);"OVERALL"
850 PRINT "VOLTAGE";:PRINT TAB(9);"PERCENT";
860 PRINT TAB(20);"VOLTS";:PRINT TAB(29);"PERCENT";:PRINT TAB(40);"LUMENS";
870 PRINT TAB(52);"PERFORMANCE";:PRINT TAB(70);"EFFICIENCY"
880 PRINT BAR$
890       IF FL=0 THEN 1050
900       IF LTA<1 AND LTB<1 AND LTC<1 THEN LPRINT:GOTO 950
910       IF LTA<1 AND LTB<1 AND LTC<1 THEN 930
920 LPRINT "Lamp Bulb = ";PRX$;" =";LVX;"volts. ";:GOTO 940
930 LPRINT "Lamp =";LVX;"volts. ";
```

-continued

```
940 LPRINT "Battery =";BVX;"volts. Voltage Drop=";TJD
950       LPRINT BAR$:LPRINT " BATTERY LEVEL";
960       LPRINT TAB(22);"LAMP VOLTAGE";
970       LPRINT TAB(40);"LIGHT";:LPRINT TAB(52);"LUMENS/WATT";
980       LPRINT TAB(70);"OVERALL"
990       LPRINT "VOLTAGE";:LPRINT TAB(9);"PERCENT";
1000      LPRINT TAB(20);"VOLTS";:LPRINT TAB(29);"PERCENT";
1010      LPRINT TAB(40);"LUMENS";:LPRINT TAB(52);"IPERFORMANCE";
1020      LPRINT TAB(70);"EFFICIENCY"
1030      LPRINT BAR$
1040      IF FL=2 THEN 1270
1050 FOR A=1 TO BX
1060      BEX=BDX-LVX:BFX=BDX-TJD
1070        IF BEX>TJD THEN LUMS=100 ELSE 1090
1080          WATA=(BDX/LVX):LMP=LVX:GOTO 1110
1090          LUMX=(BFX/LVX) CK:LUMS=INT(LUMX*1000)/10
1100          WATA=(BFX/LVX) CN:LMP=INT(BFX*10)/10
1110      BATX=INT((BDX/BVX)*1000)/10
1120      LMX=INT((LMP/LVX)*1000)/10
1130      LMWT=INT((((LUMS/((LVX/LMP)   541))*(LMP/BDX))+.5)*10)/10
1140      TRUP=INT(((LMWT/100)*LEF)*10000!)/100
1150        IF LMX<=0 OR LUMS<=0 OR LMWT<=0 OR TRUP<=0 THEN 1300
1160      PRINT BDX;:PRINT TAB(8);BATX;:PRINT TAB(14);"%";:PRINT TAB(20);LMP;
1170      PRINT TAB(28);LMX;:PRINT TAB(34);"%";:PRINT TAB(40);LUMS;
1180      PRINT TAB(46);"%";:PRINT TAB(52);LMWT;:PRINT TAB(59);"%";
1190 PRINT TAB(70);TRUP;:PRINT TAB(76);"%"
1200        IF FL=0 THEN 1270
1210          LPRINT BDX;:LPRINT TAB(8);BATX;:LPRINT TAB(14);"%";
1220          LPRINT TAB(20);LMP;:LPRINT TAB(28);LMX;:LPRINT TAB(34);"%";
1230          LPRINT TAB(40);LUMS;:LPRINT TAB(46);"%";
1240          LPRINT TAB(52);LMWT;:LPRINT TAB(59);"%";
1250          LPRINT TAB(70);TRUP;:LPRINT TAB(76);"%"
1260        IF A/57=INT(A/57) THEN LPRINT FF$:FL=2:GOTO 950
1270 BDX=BDX-.1
1280        IF BDX<1 THEN 1300
1290 NEXT A
1300      IF FL>0 THEN LPRINT FF$
1310 PRINT SXA$:END
1320 REM
1330 REM GOSUB setup routines based on ANSI (DEC VT-100) terminal codes.
1340 Z$=CHR$(27):LF$=CHR$(10):FF$=CHR$(12)   REM Escape, Line Feed & Form Feed
1350 CLS$L=Z$+"[2J":HOM$=Z$+"[f"'0      REM CLear Screen & HOMe Cursor
1360 SXA$=Z$+"[1;24r":SXB$=Z$+"[7;24r"   REM Set Display Scroll Region
1370 BAR$=STRING$(79,"-"):RETURN
1380 REM == finis ==
```

The curves represented in FIG. 3 show that while my invention may, for example, utilize a lower wattage PR-3 lamp in a 4-cell lantern arrangement, the light produced by the PR-3 lamp compares-favorably with the light level formerly provided by a typical PR-13 lamp which is commonly used in lanterns and 4-cell flashlights. The PR-3 is rated 3.57 volts while the PR-13 is rated 4.75 volts. Sylvania and Chicago Miniature Lamps are representative makers of this type of lamp and the light-level ratings for the lamps are:

TABLE II

| LAMP | LAMP FILAMENT | | LIGHT LEVEL |
|---|---|---|---|
| TYPE | VOLTAGE | CURRENT | MSCP |
| PR-3 | 3.57 | 0.50 A | 1.5 |
| PR-12 | 5.95 | 0.50 A | 2.5 |
| PR-13 | 4.75 | 0.50 A | 2.0 |

As this published parameter shows, the PR-3 has about ¾ the brightness of the PR-13. As FIG. 3 shows, the PR-13 lamp operating from a "6 volt lantern battery" produces substantially more than 2 MSCP output MB when the battery voltage is above the 4.75 volt level MA. This overvoltage operation of the PR-13 lamp produces a lot of light with the tradeoff of short lamp life and even premature burnout. In comparison, the PR-3 lamp operated by my invention produces about 1.5 MSCP at 6 volts NA, at 4.75 volts NB and the level holds constant until the battery discharges to about 4 volts NC. Meanwhile the PR-13 lamp output rapidly drops below the 4.75 volt level to about 1.5 MSCP (or the same as the PR-3) at 4.4 volts and further drops to only about 1.11 MSCP at 4 volts MD (about ⅔ battery charge level). The PR-3 curve drops-off after about 4 volts NC but remains relatively brighter at ½ battery voltage ND than what the PR-13 does ME and in fact the PR-3 continues to produce more light to a point NE representing about 2.6 volts where the two lamps match. The shaded region of the curve depicts where the PR-3 lamp actually produces more light than the uncontrolled PR-13 lamp. What is not clearly shown on the curve is a subjective, but highly important, factor: light quality or color. In the region between MA and MF on the PR-13 curve the light "yellows" to about the same extent as what the PR-3 lamp does between the NC and NF points. In other words, the quality of light, or "whiteness" remains for about ¾ of a volt further into discharge for the PR-3 than what it does for the PR-13. This says that the PR-3 lamp, with brightness reduced to its ⅔ level, may yield about 44% deeper discharge of the battery than what may be useful with the PR-13 lamp reduced to ⅔ brightness and operating with comparable filament temperature and "yellowness" of the produced light. The following table shows brightness relative with battery voltage for a PR-3 lamp operated by my invention and earlier art PR-12 and PR-13 lamps coupled directly with a standard 941 or equivalent lantern battery.

TABLE III

| LANTERN BATTERY | PRIOR ART UNCONTROLLED LAMP | | THIS INVENTION PR-3 |
|---|---|---|---|
| VOLTAGE | PR-12 | PR-13 | LAMP OUTPUT |
| 6.0 | 103% | 227% | 100% |
| 5.5 | 76% | 167% | 100% |
| 5.0 | 55% | 120% | 100% |
| 4.5 | 38% | 83% | 100% |
| 4.0 | 25% | 55% | 100% |
| 3.5 | 16% | 34% | 59% |
| 3.0 | 9% | 20% | 32% |
| 2.5 | 5% | 10% | 15% |
| 2.0 | 2% | 5% | 6% |

In FIG. 4 I show the performance efficiency of a PRIOR ART LAMP AA (a type PR-12 lamp) relative with my inventions CONTROLLED LAMP BA (a type PR-3 lamp) using the embodiment of FIG. 1. What this plot particularly shows is that with 100% battery voltage (assume 6.0 volts) the plots coincide AB,BB and produce about 100% of the LUMEMS capability for the respective lamps. As the BATTERY VOLTAGE deteriorates to about 90% (5.4 volts) curve AA drops to about 75% of effective lumens, point AE. In comparison, the CONTROLLED LAMP continues to produce nearly 100% output. As the battery voltage drops further to about 75% (4.5 volts), the prior art plot point AC shows that the intensity in lumens has now slumped to only about 40% efficiency. As the plot shows, my CONTROLLED LAMP shows onset of a substantial dropoff of luminous output only when the battery reaches about ⅔ voltage (4.0 volts). Now compare the real efficiencies:

TABLE IV

| BATTERY VOLTAGE | UNCONTROLLED EFFICIENCY | EFFICIENCY OF INVENTION | IMPROVEMENT BY INVENTION |
|---|---|---|---|
| 6.0 | 100% | 54% | −46% |
| 5.5 | 77% | 61% | −16% |
| 5.0 | 52% | 66% | +14% |
| 4.5 | 40% | 74% | +34% |
| 4.0 | 27% | 83% (1) | +56% |
| 3.5 | 17% | 44% (2) | +27% |

NOTES:
(1) Assuming Controlled Lamp Lumens drop-off by about 4%
(2) Assuming Controlled Lamp Lumens drop-off by about 50% and drop across transistor 100-1 about 0.4 volt.

A remarkable +56% higher efficiency (or about a 300% improvement) is attained at the usual battery end-of-life level (4.0 volts). More importantly, the light output of the invention remains desirably WHITE in color and does not become dim and pale yellow which is characteristic of an uncontrolled lamp operated from dry cell batteries as the terminal voltage of the battery drops-off. In practice, it is not only the lumens output dropoff which detracts from flashlight performance, but also this gradual yellowing of the light, along with the dim-down.

Controlled operation of a PR-3 lamp (rated 3.57 volts, 0.5 ampere) by my invention such as depicted in FIG. 1 is shown in the graphical plot of FIG. 5. Using a 6 volt lantern battery (Ray-O-Vac type 941), initially about 6 volts DC is made available for operation of the lamp. This level is dropped to the desired about 3.58 volt level by action of my circuitry. As a result, the overall efficiency of the lamp operation peaks EDX at about 6.2% when the available battery voltage has discharged to about 4 volts. Realizing that a PR-3 lamp might be "normalized" as 7% efficient (with 3.57 volts applied to its terminals), the difference hereby shown is the 7% performance of the bulb less the small losses across the pass transistor 100-1 and the control circuitry currents. You will note that with a fresh fully charged battery providing about 6 volts, the shown efficiency is depicted ECX as about 4.4%. The good news is that, with the battery voltage between about 6 volts and about 4 volts the quality of the light produced by the lamp does not change. It remains maximally whitish and pleasing. As I said, the battery operating range for purpose of the depiction of FIG. 1 is between full charge and ⅔ charge (e.g., 6 to 4 volts). If operation continues below the ⅔ charge level, say to half voltage, the lamp performance point EDZ drops off to about 3.3% efficiency. This dropoff mostly represents deterioration in light quality produced by the lamp. The light becomes more yellowish. However, it should be noted that in comparing this the curve of, say FIG. 2, at ⅔ voltage the lamp performance is remarkedly better using my invention, particularly in view of the maintained whiteness of the delivered light. Furthermore, as the curve of FIG. 4 depicts relative to this plot is that I maintain the lamps output level nearly constant between full battery voltage and ⅔ battery voltage and without undesirable yellowing of the light quality.

A prior art circuit is shown in FIG. 6 which was the subject of a U.S. Pat. No. 4,499,525 issued to Henry R. Mallory, Feb. 12, 1985. In this patent a lantern battery 12 provides current to a lamp 10 through a switching transistor 16. Although at first glance, the hookup may resemble certain of the embodiments of my instant invention, this earlier '525 patent operates in a bi-level switching mode wherein the transistor 16 is either in a fully saturated "on" state or else fully "off". Other components of this circuit develop the necessary pulse controlled operation and regulatory feedback. Operational details may be determined by referring to the published '525 patent.

In the operation of Mallory '525 it is urgent that the power transistor 16 becomes instantly and fully saturated with very little voltage drop thereacross during the "on" state and of course alternately, fully "off". Table III shows efficiency attainable, and conversely losses produced, with various levels of voltage drop which might occur across the power transistor 16 and how this voltage drop impacts operating efficiency of the switching transistor portion of the circuit.

TABLE V

| BATTERY | LOSSES ACROSS POWER TRANSISTOR WHEN "ON" COLLECTOR TO EMITTER SATURATION VOLTAGE | | | | | | | |
|---|---|---|---|---|---|---|---|---|
| VOLTAGE | 0.2 | 0.3 | 0.4 | 0.5 | 0.6 | 0.7 | 0.8 | 0.9 |
| 1 V | 20% | 30% | 40% | 50% | 60% | 70% | 80% | 90% |
| 2 V | 10% | 15% | 20% | 25% | 30% | 35% | 40% | 45% |
| 3 V | 7% | 10% | 13% | 17% | 20% | 23% | 27% | 30% |
| 4 V | 5% | 8% | 10% | 13% | 15% | 18% | 20% | 23% |
| 5 V | 4% | 6% | 8% | 10% | 12% | 14% | 16% | 18% |
| 6 V | 3% | 5% | 7% | 8% | 10% | 12% | 13% | 15% |

ON-STATE LOSSES DERIVED FROM Vces DROP IN RELATION TO BATTERY VOLTS

Switching power supplies, of which this teaching of Mallory is a mere variation, are well understood in the art and the priority for fully saturated "on" state performance is also well known as being essential for obtaining decent operating efficiency. In order to turn the transistor 16 "on", collector current drawn through the control transistor 18 flows through the base of the pass transistor 16. It is necessary that the transistor 16 base current is sufficient to obtain the desired saturation, but not excessively more. In effect, the required base current is approximated by about $$I_B = I_L / B$$

Where:

$I_B$=Base Current $I_L$=Max. Lamp 10 Current

B=Transistor 16 Beta

In this arrangement, the battery 12 is given to provide between about 4 and 6 volts DC depending upon its discharge (e.g., "used up") condition. With about 6 volts, current flow through the resistors 30,34 should fully saturate the control transistor 18 (which the manufacturer Motorola gives as having a minimum beta of 60 and a typical beta spread of 60–300). As a result, the collector current through the transistor 18 may be:

$$I_C = ((E_{BAT} - E_{BE})/(R_{30} + R_{34})) \times B$$

Where:

$E_{BE}$=Transistor 18 base-emitter drop $E_{BAT}$=Battery 12 voltage $I_C$=Transistor 18 collector current and Transistor 16 base current Which becomes:

$I_C$=(6−0.7)/(5600+18000) therefore $I_C$=(5.3/23600)×60=0.01347 A or 0.1347 A×1000=13.47 milliamperes For a lamp 10 which may draw about 500 milliamperes, the pass transistor 16 needs a minimum gain of:

$$B_{16} = 500/13.47 = 37.12 \text{ minimum beta}$$

and as a matter of good engineering practice this beta should be several times higher since the initial inrush current drawn by the lamp 16 is ordinarily several times higher than the nominal operating current. This value is a far cry from the beta of 10 cited by Mallory in the '525 patent.

If transistor 18 is assumed to have a "best case" beta of 300, then working through the formulae shows that the transistor 16 needs a beta of at least 7.43 with 6 volts delivered by the battery 12 and a minimum beta of 11.9 with the battery discharged to 4 volts DC.

When the base of the transistor 16 is overdriven to assure saturation, the considerable base current is merely wasted. As a result of nominal transistor beta spread (particularly in inexpensive grade transistors) considerable efficiency variation occurs and the overall electrical efficiency can become substantially compromised when component values are selected so as to produce satisfactory operation with the worst-case scenario of transistor and resistor tolerances. In other words, the alleged efficiencies of the '525 patent are not necessarily obtainable in economic production lots unless more expensive component selection is provided. The purpose for this illustration is to show that certain limitations (particularly due to circuit parameter intolerance) are embodied which prevent the earlier '525 invention from obtaining the efficiencies gained by my invention not only in the sense of electrical performance, but also regarding more tolerant component selection and in the most basic form for my invention even fewer parts to achieve performance which, on the whole, is considerably better than what has been found to be provided by the circuitry claimed by the '525 patent.

With FIG. 7 I show that the control transistor 102-1 collector may include a capacitor 109 coupled between a diode set 108-2 and diode 108-4 to permit some degree of AC positive feedback having a time constant determined in part by the value of the capacitor 109. When the level at the juncture 107 rises so as to overcome the base voltage of the transistor 102-1, the collector level of the transistor 102-1 rises and in part couples through the capacitor 109 whereupon it is steered through the diode 108-4 to the juncture 107 causing even more current change through the transistor 102-1.

The curve depicted by FIG. 8 shows the measured performance of flashlight apparatus built in accordance with the teaching of FIG. 1 and FIG. 7. This performance is measured utilizing a 6-volt lantern battery, a PR-3 flashlight lamp and the following typical component values:

CIRCUIT COMPONENT VALUES FOR FIG. 1

| ELEMENT | DESCRIPTION |
|---|---|
| 100-1 | PNP Power Transistor, GE D41D |
| 102-1 | NPN Transistor 2N4124 |
| 105-1 | Resistor, 680 ohms |
| 104-1, 104-2 | Diode 1N4148 or 1N914 |
| 106 | Resistor, 22 ohms |
| 108 | Diodes each 1N4148 or 1N914 |

With a fresh battery about 6 volts is produced and the result is that the lamp 1 is supplied with about 3.5 volts, point CA. As the battery discharges, the 3.5 volt lamp level is maintained until the battery drops to about 4.5 volts CB whereupon the lamp voltage gently drops off to level CC which coincides with about a 4 volt battery level. This represents about 33% discharge of the battery and as the battery drops below 4 volts, the lamp level also decreases to a point CD where the battery voltage has dropped about 50% and the lamp voltage has dropped about 0.9 volt, or about −20%. As this plot shows, exceptional lamp 1 terminal voltage performance is maintained although the battery discharges −33% from 6 volts to about 4 volts.

I offer the following BASIC computer program as a quick way to determine the lamp conditions and performance for virtually any lamp:

```
10  REM Incandescent Light Source Changes in APPLIED VOLTS, related  | Ver. 1.02
20  REM percentage reduction in VOLTS, LUMENS, and WATTS.            | H.Weber
30  REM Formulae Ref: Electrical Engineer's Handbook; Pender &       | K1VTW
40  REM Delmar; John Wiley & Sons Publisher; Chap. 15, Page 14       | 3/16/90
50  REM - - - - - - - - - - - - - - - - - - - - - - - - - - - - - - - - - - - - - - - - - - - -
60  GOTO 90                          REM Ver. 1.02 10/12/94
70  PRINT CLS$
80  PRINT "To QUIT ... ENTER > Q < Now.":PRINT:GOTO 110
90  Z$=CHR$(27):CLS$=Z$+"[2J"+Z$+"[f"      REM ANSI screen control functions
100 PRINT CLS$:PRINT:PRINT
```

-continued

```
110 INPUT "ENTER>>   DO you want PRINT-OUT Copy ?   Y/N ";PTC$
120   IF PTC$="Y" OR PTC$="y" THEN PTR=1 ELSE PTR=0
130   IF PTC$="Q" OR PTC$="q" THEN 800
140 PRINT CLS$
150 PRINT:PRINT "SELECT>>   Type of Light Bulb:"
160 PRINT:PRINT TAB(16);"1. Standard Incandescent"
170 PRINT TAB(16);"2. Krypton Incandescent"
180 PRINT:PRINT "ENTER>>   Choice   1 or 2";
190 PRINT TAB(42);"";:INPUT LTYP$
200   IF VAL(LTYP$)<1 OR VAL(LTYP$)>2 THEN 180
210   IF VAL(LTYP$)=1 THEN CA=3.38:CB=.541:EFX=7
220   IF VAL(LTYP$)=2 THEN CA=2.76:CB=.441:EFX=9
230 PRINT:INPUT "ENTER>>   Light Bulb RATED Voltage:   ";LVX$
240 LV=VAL(LVX$)
250   IF LV<1.5 OR LV>250 THEN 100
260 PRINT CLS$
270 PRINT " Actual";:PRINT TAB(10);"Percent";:PRINT TAB(20);"Percent";
280 PRINT TAB(30);"Percent";:PRINT TAB(40);"Percent";:PRINT TAB(50);"Percent";
290 PRINT TAB(60);"Percent"
300 PRINT " Lamp";:PRINT TAB(10);"Voltage";:PRINT TAB(20);"Lumens";
310 PRINT TAB(30);"Lamp";:PRINT TAB(40);"Lamp";:PRINT TAB(50);"Lumens/";
320 PRINT TAB(60);"Overall"
330 PRINT " Volts";:PRINT TAB(10);"Applied";:PRINT TAB(20);"Produced";
340 PRINT TAB(30);"Current";:PRINT TAB(40);"Wattage";:PRINT TAB(50);"Watt";
350 PRINT TAB(60);"Efficiency"
360 PRINT "|";:PRINT STRING$(78,"-");:PRINT "|"
370   IF PTR=0 THEN 480
380 LPRINT " Actual";:LPRINT TAB(10);"Percent";:LPRINT TAB(20);"Percent";
390 LPRINT TAB(30);"Percent";:LPRINT TAB(40);"Percent";
400 LPRINT TAB(50);"Percent";:LPRINT TAB(60);"Percent"
410 LPRINT " Lamp";:LPRINT TAB(10);"Voltage";:LPRINT TAB(20);"Lumens";
420 LPRINT TAB(30);"Lamp";:LPRINT TAB(40);"Lamp";
430 LPRINT TAB(50);"Lumens/";:LPRINT TAB(60);"Overall"
440 LPRINT " Volts";:LPRINT TAB(10);"Applied";:LPRINT TAB(20);"Produced";
450 LPRINT TAB(30);"Current";:LPRINT TAB(40);"Wattage";
460 LPRINT TAB(50);"Watt";:LPRINT TAB(60);"Efficiency"
470 LPRINT "|";:LPRINT STRING$(78,"-");:LPRINT "|"
480 PRINT Z$+"[6;24r"+Z$+"[5f"      REM ANSI screen control functions
490   IF LV*10<>INT(LV*10) THEN SV=((LV*10)-(INT(LV*10)))/10
500   IF LV=<6 THEN STP=.1:GOTO 530
510   IF LV=<50 THEN STP=1:GOTO 530
520 STP=2
530 FOR A=1 TO INT(LV*10)/STP
540     IF A<2 THEN VL=LV:GOTO 570
550     IF A<3 AND SV<>0 THEN VL=VL-SV ELSE VL=VL-STP
560     IF VL<1 THEN 750
570   EF=INT(((VL/LV) CA)*1000)/10
580   VRD=INT(((VL/LV)*1000)+.05)/10
590   IL=INT(((VL/LV) CB)*1000)/10
600   WT=INT(((VL*(IL/100))/LV)*1000)/10
610   LMWT=INT(1/((1/(:EF/100))*(WT/100))*1000)/10
620   NTEF=INT(EFX*(LMWT/100)*10)/10
630     IF EF<75 THEN FLA=1
640     IF VRD<65 THEN FLB=1
650   PRINT VL;:PRINT TAB(10);VRD;:PRINT TAB(20);EF;
660   PRINT TAB(30);IL;:PRINT TAB(40);WT;:PRINT TAB(50);LMWT;
670   PRINT TAB(60);NTEF;
680     IF PTR=0 THEN 720
690   LPRINT VL;:LPRINT TAB(10);VRD;:LPRINT TAB(20);EF;
700   LPRINT TAB(30);IL;:LPRINT TAB(40);WT;:LPRINT TAB(50);LMWT;
710   LPRINT TAB(60);NTEF;
720     IF PTR=1 THEN LPRINT
730   PRINT
740 NEXT A
750   IF PTR=1 THEN LPRINT CHR$(12)
760 PRINT TAB(50); "Press ANY KEY to continue...";
770 PRINT Z$+"[1;24r";
780 X$=INPUT$(1)
790 GOTO 70
800 END
810 REM == finis ==
```

What results from running this program is a tabulation of numerous characteristics pertaining to the operation of any lamp that might be useful with my invention, assuming a nominal rated voltage efficiency for the lamp of 7% (which is considered typical for ordinary incandescent lamps). If you want to find a different overall efficiency rating for any particular standard type lamp, simply change the value EFX=7 appearing on program line 210 from "7" to whatever efficiency value you may elect. For a Krypton lamp, the value EFX=9 (e.g., 9% efficiency) on program line 220 may also be changed to a different efficiency value.

TABLE VI

| Actual Lamp Volts | Percent Voltage Applied | Percent Lumens Produced | Percent Lamp Current | Percent Lamp Wattage | Percent Lumens/ Watt | Percent Overall Efficiency |
|---|---|---|---|---|---|---|
| 5.95 | 100 | 100 | 100 | 100 | 100 | 7 |
| 5.9 | 99.1 | 97.1 | 99.5 | 98.6 | 98.4 | 6.8 |
| 5.8 | 97.4 | 91.7 | 98.6 | 96.1 | 95.4 | 6.6 |
| . | | | | | | |
| . | | | | | | |
| . | | | | | | |
| 4.2 | 70.5 | 30.8 | 82.8 | 58.4 | 52.7 | 3.6 |
| 4.1 | 68.9 | 28.4 | 81.7 | 56.2 | 50.5 | 3.5 |
| 4.0 | 67.2 | 26.1 | 80.6 | 54.1 | 48.2 | 3.3 |
| 3.9 | 65.5 | 23.9 | 79.5 | 52.1 | 45.8 | 3.2 |
| . | | | | | | |
| . | | | | | | |
| . | | | | | | |
| 3.1 | 52.1 | 11 | 70.2 | 36.5 | 30.1 | 2.1 |
| 3.0 | 50.4 | 9.8 | 69 | 34.7 | 28.2 | 1.9 |
| 2.9 | 48.7 | 8.8 | 67.7 | 32.9 | 26.7 | 1.8 |
| . | | | | | | |
| . | | | | | | |
| . | | | | | | |

The circuit of FIG. 9 depicts a variation on the earlier circuit of FIG. 1 producing higher performance. An NPN transistor 103-1 includes a zener diode 110 and resistor 111 in the base circuit coupled between line ELA and ground. As the lamp voltage delivered through an NPN power transistor 100-2 increases a point is reached where the zener diode 110 conducts holding the base of the transistor 103-1 at a steady level while the emitter continues to rise. In effect this forward biases the transistor causing the collector juncture with the resistor 106, capacitor 112 and emitter of a PNP transistor (say 2N4125) to rise, effectively reverse biasing the transistor 106 and reducing further collector current flow and thereby limiting current flow through the NPN pass transistor 100-2. The diodes 104-3,104-4 provide fixed reference level ERA bias for the transistor 102-2 base and the result is that the transistor 102-2 operates as a constant current source providing just enough current to the base of the power transistor 100-2 to maintain the necessary level of current flow therethrough to keep the lamp terminal voltage about constant. As a result of this constant current action, no more current is consumed than necessary to meet the task at hand, unlike the wasteful over-current and deep saturation mode of the earlier Mallory '525 invention.

A flashlight that "flashes" may be implemented by my embodiment of FIG. 10. A CMOS integrated circuit (say type CD4069B) including inverter sections 114-1 through 114-6 operates to control current flow between the battery 2-1 and lamp 1 via the PNP power transistor 100-1. If the juncture of resistor 115 and the inverter 114-1 is instead tied to the battery line EBA, what remains is a regulator similar to that depicted in FIG. 1 except for the darlington configuration of the NPN transistor 102-3 in conjunction with the NPN transistor 102-1. As a result, the base current delivered through resistor 115 is greatly reduced thereby enabling the base of the transistor 102-3 to be supplied by the current delivered by the inverters 114-1,114-2,114-3,114-4. Inverters 114-5,114-6 together with capacitor 117, resistor 118 and rheostat 119 act in concert as a multivibrator oscillator. Ordinarily, the frequency is set very low, typically on the order of 0.1 to 20 hertz. As a result, the lamp 1 "flashes" on and off at the oscillator determined rate.

Application for this sort of flashlight is manifold. For example, police may find the blinding effect of the flashing light shone into the face of a suspect an effective aid in curtailing rash action by the suspect since the light is blinding when the rate is set moderately low, say about 3–8 hertz or so. This effect occurs because the flashing light directed into the eyes of a suspect prevents the suspect's eyes from dark adapting and therefore effectively "blinds" the suspect. Conversely, the officer using the light projected on the suspect or in a dimly lit area is actually given better night vision due to the characteristic of the eye to dark adapt and then sieze an image of whatever is brightly but momentarily illuminated. Through the variable provision afforded by the rheostat 119 which enables change of flashing rate by a user, it is possible to optimize the flash rate to suit the individual preferences of the user and to best provide for the desired effect, e.g. blinding of a suspect, enhanced night vision through allowing the user's eyes to dark adapt and so forth. As an adjunct, battery life may be doubled since the flashing duration is about 50% "on", 50% "off" in the shown embodiment.

Brightness of the lamp may be varied over a predetermined range by my circuit configuration of FIG. 11. The NPN control transistor 102-1 additionally includes a second PNP control transistor 102-4 seriately coupled in a common emitter configuration. Two reference diodes 104-1,104-2 provide about +1.4 volts reference level ERA to the base of the transistor 102-1. The base of the other transistor 102-4 is coupled with the arm of a BRIGHTNESS LEVEL potentiometer 120 which, together with a resistor 122 is coupled to a tap between diodes 126-1,126-2 and the juncture of diode 126-3 with a resistor 124. This arrangement permits increasing the lamp 1 brightness as the arm of the potentiometer is moved nearer the resistor 124. The result is a variable brightness lantern or flashlight which maintains a constant level of brightness at any setting within the potentiometer range irrespective of battery condition between about full charge and about ⅔ charge.

An interesting variation for flashlight control appears in my FIG. 12 which may have particular utility for police and military application whereby the flashlight, upon initial turn-on, comes on with an unusual flash of momentary brightness whereafter it steps-back to a more normal and unconditionally constant level of brightness. In this embodiment, an operational amplifier 130 includes voltage reference diodes 104-3,104-4 (say 1N4148) coupling about +1.4 volts ERB to the non-inverting (+) input. When initially turned-on, the inverting (−) input as coupled with the juncture of resistors 132-1,132-2,132-3 and capacitor 136 is low relative with the (+) input and as a result, the amplifier 130 output is driven high as coupled through a resistor 132 with the NPN control transistor 102-5 base. The control transistor draws considerable current through the resistor 105-3 and the pass transistor 100-1 base circuit, thereby producing nearly full battery power flow to the lamp 1 and as a result the lamp develops unusually bright intensity. An immediate flow of current through the resistor 132-1 charges the capacitor 136 and after a brief time delay of preferably 0.1 to about 1 second, the voltage level across the capacitor 136 rises to a level established by the ratio of the resistors 132-1,132-2 and effectively reduces the lamp voltage to its nominal (e.g., rated) level. The ensuing initial bright flash may be used to startle or even momentarily blind a suspect being apprehended by a police officer, for example. A diode 134 and the resistor 132-3 serve to reset the device when the switch 4-1 is opened, thereby allowing almost immediate repeating of the bright-flash mode of operation when desired.

In my FIG. 13 a power transistor 140 is seriately coupled between the lamp 1 and ground while the battery 2-1 is coupled via a switch 4-1 with the other side of the lamp 1.

A source of constant current including a transistor 142, resistors 145,148 and diodes 146-1,146-2 act to provide base current for the power transistor 140. A string of diodes 144 develop about 2.8 volt drop thereacross as coupled with the transistor 142 emitter. When the collector of the transistor is drawn down by current flow, diodes 144 conduct and when about 0.7 volts develops across the resistor 148 current flow through the transistor 142 is reduced thereby reducing current through the transistor 140 and equilibrium is reached where the voltage drop across the lamp 1 is about 3.5 volts.

Viewing now FIG. 14 shows use of a MOSFET power transistor 150 as a controllable pass device between the battery 2-1 and the lamp load 1. Since the battery voltage 2-1 may be relatively low, say 4–6 volts, this is insufficient to reliably bias the MOSFET 150. Therefore a supplemental battery 151 providing, say, 9 volts DC may be included to provide bias for the MOSFET through resistors 152,156. A NPN control transistor 153 is coupled with the juncture of resistors 152,156. When the lamp voltage rises to a point where the reference diodes 154 conduct to an extent sufficient to develop about 0.7 volt across the resistor 155, the transistor 153 is turned on to provide analog current increase through the resistor 152 and thereby reduce the forward bias brought to the MOSFET gate.

In my FIG. 15 I show a diode 162 (or alternatively a resistor 164) hooked between the lamp 1 and ground whereby the voltage drop +ELFB developed across the diode 162 appears at the emitter of the control transistor 160. When the lamp voltage ELA increases to a point where diodes 154 conduct and the effect of the diode 162 voltage drop and the forward voltage drop of the base to emitter junction of the transistor 160 is overcome and level +EFB is reached, current draws through the transistor 160 collector that reduces the bias on the MOSFET 150. Equilibrium is reached when about 2.8 volts appears across the lamp 1 and the value remains constant for any battery voltage between about 6 volts and about 3.5 volts. In this embodiment, as well as that of FIG. 14, I anticipate that the separate source of bias voltage provided by the battery 151,151-1 might just as well be produced by a converter suitable for stepping the lower battery voltage EBA up to the higher level +EBB.

Two sets of batteries 2-4,2-5 are series coupled in my hookup of FIG. 16. When the battery 2-4 is substantially charged, a high-conductance steering diode 260-1 couples the connection +EBA directly with the lamp 1. As the battery 2-4 discharges, the voltage level ELA on line 262 is compared with a reference level 266 and when the level of ELA provided by the battery 2-4 drops to a predetermined level a control circuit 264 sends a signal on line 268 to an impeder 270-1 and enables the impeder to deliver power from the battery 2-5 to supplement that provided from the battery 2-4 and thereby keep the lamp power about constant.

I now show an implementation for a circuit which may include a tri-cell battery 2-6 having a 4.5 volt level when fresh that couples through a high conductance power diode (e.g., 1N4001, etc.) with the lamp 1. A stack of diodes 108-1 offering about a 2.8 volt drop couples between the lamp line ELA and the base of a NPN control transistor 276. So long as the level of lamp voltage delivered through the steering diode 260-2 and appearing on line ELA exceeds about 3.5 volts the reference diodes 108-1 conduct turning the transistor 276 on and pulling the line 278 low thereby reverse biasing the NPN transistor 274-1 with the result that the transistor 274-1 is maintained off. As a result, no current flows with the PNP power transistor 272-1 base and no current flows through the power transistor. As the lamp voltage level ELA decreases and the diodes 108-1 are less conductive, the transistor 276 is at least partly inhibited and the collector line 278 rises towards +EBC thereby biasing the base of the NPN transistor 274-1 positive relative with its emitter which couples with the +EBA line. As a result, the transistor 274-1 at least partly conducts, drawing current through the PNP power transistor 272-1 emitter to base circuit whereby the emitter couples with the most positive +EBC line whilst the base seeks its path via the transistor 274-1 with the relatively negative +EBA line. A portion of the battery 2-7 current flows to the lamp which is just sufficient to maintain the level on the +ELA line about constant irrespective of discharge of the batteries 2-6,2-7.

In my FIG. 18 two battery sets 2-5,2-6 provide power for the lamp 1. When the battery 2-6 is substantially charged, the steering diode 260-2 couples the EBA battery power with the +ELA lamp power line. Typically, the battery 2-6 may have 3 cells providing about 4.5 volts when fresh. As a result, about 3.8 volt appears on the +ELA line, allowing for about a 0.7 volt drop through the steering diode 260-2. In the shown hookup, the reference diode set 108-2 includes three diodes and provides an about 2.1 volt drop thereacross, as coupled with the juncture of resistor 166-3 and the transistor 276 base. As long as the level on line +ELA is sufficiently high (e.g., above about 2.8 volts) the transistor base 276 receives current which produces collector current flow and a reduction of level on line 278 as coupled with a base of a transistor 274-2. When the level on line 278 is not greater than about +0.7 volt little current flows through the control transistor 274-2 and the base of the PNP pass transistor receives insufficient current to produce any significant current flow therethrough between the battery 2-5 and the lamp 1. As the charge of the batteries 2-6 decreases a point is reached around +2.8 volts whereby the diodes 108-2 are less conductive and the base of the transistor 276 is starved for current. As a result the collector line 278 rises in level to a point where current may flow through the transistor 274-2 and therewith the base of the pass transistor 272-2. This action delivers current from the battery 2-5 (that might include 2 cells producing about 3 volts) to the lamp 1 in a portion just sufficient to maintain the voltage level across the lamp about constant around 2.8 volts.

In FIG. 19 the first battery 2-6 may deliver about 4.5 volts which couples trough a power diode 260-3 to establish about 3.8 volts across the lamp 1. For so long as the lamp voltage level +ELA exceeds about 3.5 volts, the diodes 108-1 are forward biased and conduct substantial current through the resistor 166-1 and into the base of the transistor 276. As a result, the collector line 278 is held low and the NPN transistor, which looks like an emitter follower, delivers negligible current between the second battery 2-5 and the lamp. As the charge across the battery 2-6 deteriorates and the level which may appear on line +ELA decreases to less than about 3.5 volts the current flowing through the reference diodes 108-1 decreases and effectively starves the base of the transistor 276 whereupon the transistor collector current decreases and the level of line 278 increases. A PNP transistor 282 together with a diode 284 and resistors 286,288 provides a constant current source for the base of the transistor 280 and with the reduced current draw through the transistor 276, the voltage level appearing at the pass transistor 288 base increases as does the level of current flowing through the pass transistor. As a result, a portion of the charge held in the second battery 2-5 couples to the lamp to boost the level on the lamp line +ELA and hold the lamp operation about constant.

In FIG. 20 a first battery 2-4 and second battery 2-5 couple in series with a pass transistor 272-3 and the lamp 1.

Additionally, a high conductance power diode couples between the juncture of the batteries 2-4,2-5 and the lamp 1. Whenever the level of voltage delivered by the battery 2-4 is in excess of about 3 volts the diodes 108-2 developing a drop across the resistor 106 which couples with the emitter of a NPN transistor 290. The base of this transistor couples with the juncture of a diode 296 and resistor 298 and current flow through the resistor 298, the diode 296 and the resistor 294 is sufficient to develop a forward bias on the transistor 290 and cause collector current flow through the base-emitter portion of a PNP power transistor 272-3. However, the drop developed across the resistor 106 negates this current flow and the lamp 1 receives only current flow from the first battery 2-4. As the first battery 2-4 discharges and a level is reached where the diodes 108-2 are no longer fully conductive, then the collector current of the transistor 290 appearing on line 292 turns the pass transistor 272-3 on and the second battery 2-5 power also couples with the lamp 1 in a proportion as necessary to keep the +ELA level coupled with the lamp about constant.

Yet another embodiment of this invention appears in FIG. 21 whereby the first and second batteries may couple through a steering diode 260-4 and a power pass transistor 272-3 operative as a variable impeder to deliver a portion of the second battery power to the lamp 1 when an available level of the first battery power drops below a predetermined level. In this hookup, diodes 200-1,200-2 seriately couple with the base of a PNP transistor 300 which is further hooked in a common emitter circuit with a NPN transistor 302. A reference voltage +ERA is developed at the juncture of diodes 304 with resistor 306, providing about +1.4 volts. As the +ELA level increases the level developed across the resistor 166-3 may increase to where the transistor 302 is back-biased and the collector may rise or at least no substantial current flow through the collector circuit. Conversely, when the first battery level drops due to discharge, a point is reached where the base of the transistor 300 is effectively pulled to ground via the resistor 166-3 and the transistor 302 is turned on to some extent as may be necessary to deliver sufficient current through the pass transistor 272-3 to maintain the lamp voltage about constant. A capacitor 308 provides a degree of AC positive feedback, as coupled between the transistor 302 collector and the juncture of diodes 220-1 with diode 220-2.

A further arrangement of my invention is now shown in FIG. 22 which includes reference diodes 108-3, a PNP control transistor 310, reference diodes 312, an NPN control transistor 214 all coupled trough a resistor 316 and a light emitting diode (LED) 318 with the base of the power transistor 272-3. As the charge of the battery 2-4 decreases, the level coupled through the steering diode 260-4 lessens to a point where the transistors 310,312 turn-on drawing a portion of the second battery power through the transistor 272-3 and maintaining the lamp voltage about constant even with battery dissipation. The LED lights when the pass transistor 272-3 draws current and therefore serves as a telltale that at least the first battery is becoming weak.

A refinement depicted in FIG. 23 shows an operational amplifier 320 having its non-inverting input coupled with an avalanche reference diode 324 while the inverting (–) input couples with the juncture of a voltage divider including resistors 322-1,322-2. The first battery power 2-4 couples through the steering diode 260-4 and provides initial operating levels for the lamp 1. As the first battery becomes progressively more exhausted, the level applied to the (–) input of the amplifier 320 decreases. As a result the amplifier 320 output increases as coupled with the base of a NPN transistor 330. This initiates considerable collector current flow on line 336 that feeds current with the base of the power transistor 272-3 thereby initiating coupling of the second battery 2-5 power with the lamp. Diodes 334 may be provided to set limits on the current flow which may be delivered by the NPN transistor 330 collector circuit.

In my invention's FIG. 24 I show that a sample of the light produced by the lamp 1 may couple with a phototransistor 340. As the light level increases, so does the phototransistor current on line 342, effectively drawing line 342 towards ground. A NPN transistor 348 includes a base coupled seriately with a resistor 344 and a potentiometer 346, whereby the arm of the potentiometer couples with line 342. Initially and "in the dark" little if any light reaches the phototransistor and as a result current flow through the resistor 344 and potentiometer 346 initiates forward bias on the base of the transistor 348. Substantial collector current flows and the base of the power transistor 372-3 is forward biased. As a result, the lamp receives operating power. As light reaches the phototransistor (from the energized lamp 1), the phototransistor becomes forward biased lowering the collector impedance and shunting current away from the transistor 348 base via the potentiometer 346 arm. As a result, forward bias to the power transistor 372-3 is reduced. A power diode 260-4 may be coupled between the juncture of the first battery 2-4 and second battery 2-5 and the lamp power line +ELA. Whenever the charge level of the first battery 2-4 is sufficient to operate the lamp, no substantial power flows through the pass transistor 372-3 and the energy of the second battery 2-5 is conserved for use whenever the first battery weakens. I also anticipate that the potentiometer 346 may be a preset device, or it may be manually adjustable by an operator whereupon it behaves in a manner convenient to dim and brighten the level of light produced by the lamp 1.

Two sets of batteries 2-1,2-8 are utilized in my invention's arrangement of FIG. 25. The first battery 2-1 couples through a blocking diode (e.g., 1N4001, etc.) with the lamp 1. If the battery comprises 4 cells as is typical of a common "lantern battery" or else simply 4 D cells, about 6 volts appears across the terminals of the battery when it is fresh and fully charged. Allowing about 0.7 volt drop across the diode 260-5 initially delivers about 5.3 volts ELA to the lamp 1. The lamp may be a standard type PR-13 rated for 4.75 volts, 0.5 ampere (2.37 watts) in this embodiment. Since it is well understood that the initial battery voltage quickly drops to a lesser level, the 4.75 volt rating of the bulb is met as soon as the battery terminal voltage drops to 5.45 volts. A control circuit 380 is coupled with the lamp voltage ELA. The control circuit is also provided with a level reference 382. Operation of the control circuit may be determined to inhibit the impeder whenever the first battery 2-1 is capable of supplying sufficient lamp power and conversely to enable current to flow from the second battery 2-8 whenever the first battery 2-1 charge deteriorates below a predetermined value. Power may be turned on and off by a switch 4-2.

A more specific version of my invention including dual battery operation appears in FIG. 26. When the switch 4-2 is closed, the first battery 2-1 provides power to the lamp 1 via the steering diode 260-5. For this discussion, the batteries 2-1,2-8 may each be 4 D cells, or a common "lantern battery". Initially about 6 volts is delivered by a fresh battery, but as said before, this level quickly settles down to a lesser value that, together with the 0.7 volt drop across the diode 260-5, is about right to power a standard PR-13 miniature incandescent lamp as the lamp 1. The control circuit 390 may be an operational amplifier having an inverting input (−) that couples through a diode 391 to ground. Therefore the (−) input is set about +0.7 volt above ground level. The amplifier 390 further includes a non-inverting input (+) that couples with the juncture of a voltage reference diode 392 and a resistor 394. The voltage reference diode also couples with the lamp power line ELA. The reference diode, which may conveniently be a zener diode or any equivalent sort of voltage responsive device, is selected to have a breakdown (or avalanche) voltage level about 0.7 volt less than the desired minimum lamp level ELA which may occur before the second battery 2-8 kicks-in. For mere example, this minimum level of ELA may be selected as 4.2 volts and therefore the zener diode 392 may be picked to have a zener voltage Vz of:

$$V_z=(4.2V-0.7V)=3.5 \text{ volts.}$$

Therefore as long as the voltage level provided by the first battery 2-1 is sufficient to maintain the lamp ELA level above about +4.2 volts, the output line 396 of the operational amplifier is held high and the impeder transistor 398 is off. Whenever the lamp level drops below about +4.2 volts, the zener diode impedance increases and the resistor 394 effectively pulls the (+) input to ground with the result that the +0.7 volt level on the (−) input drives the operational amplifier output line 396 low, drawing current through the base circuit of the pass transistor 398 and delivering current from the second battery 2-8 to the lamp circuit ELA. A state of equilibrium is attained in this closed loop arrangement whereby the impeder transistor 398 delivers just enough second battery 2-8 power to overcome the deterioration of the first battery 2-1 level for as long as the second battery 2-8 holds sufficient charge within itself.

In view of the foregoing several illustrative teachings, it is obvious that the several objects and goals of my invention are achieved and other advantages and features are admitted to. As it is reasonable that various changes may be made in the adaptations herein described without materially departing from the useful scope of my invention: that of obtaining increased battery life and more uniform light output throughout a battery's full life expectancy, it is intended that all the matter contained in the foregoing description or shown in the accompanying drawings shall be interpreted as illustrative of method and suitable apparatus, rather than in a limiting sense that restricts my invention to any particular embodiment form. While my embodiments show particular utility with dry-cell operated flashlights and lanterns, it shall not be misconstrued that this is a limitation, but merely an example of a particular market segment where my invention's benefit finds utility. Adaptation to vehicular lighting systems, or other kinds of lighting needs powered by batteries of any sort shall be considered as a mere obvious extension of what I now particularly teach by example. While my invention may necessarily be limited to that which I claim, I contend that such limitation shall include those variations to my claimed invention which may become obvious to a person having reasonable skill, knowledge and experience in the pertinent art of my invention. Mere engineering modifications, where they rely to any extent whatsoever upon the fundamental essence of my invention as claimed, shall be construed as being within the scope of my claimed invention.

What I claim is:

1. A method for controlling a portable battery operated electric lighting apparatus to produce a substantially constant level of illumination during battery discharge, and comprising steps of:

predetermining a first source voltage level that may be produced between a common terminal and an anticommon terminal of a fully charged first battery;

predetermining a second source voltage level that may be produced between the common terminal and the anticommon terminal of the first battery when the first battery substantially discharges to a lower voltage level usually defined as ⅔ that of the first source voltage level;

selecting a lamp having a rated filament voltage preferably 0.4 volt less than the second source voltage level;

seriately coupling the first battery, a first transistor impeder and the lamp;

determining an instant value of an usually decreasing third source voltage level produced by the battery and bounded between the first source voltage level and the second source voltage level;

variably impeding a continuous flow of power through the first transistor impeder said seriately coupled between the first battery and the lamp;

developing a steady state voltage drop across the first transistor impeder having an instant value the greater of a collector to emitter saturation voltage level of the first transistor impeder, and the difference between the determined instant value of the third voltage level and the rated filament voltage of the lamp; and, establishing a state of substantially fill said collector to emitter saturation voltage level of the first transistor impeder and thereby maintaining the steady state voltage drop preferably less than 0.4 volt thereacross when the immediate voltage level produced between the common terminal and the anticommon terminal of the first battery discharges to a level less than the second source voltage level.

2. The method for controlling the portable battery operated electric lighting apparatus of claim 1 comprising a further step of:

changing the instant value of the steady state voltage drop developed across the first transistor impeder substantially in proportion to an effective difference between the rated filament voltage and the determined said third source voltage level.

3. The method for controlling the portable battery operated electric lighting apparatus of claim 1 comprising steps of:

tapping the first battery between a common terminal and an anticommon terminal thereof to include an interterminal relative with the common terminal and therebetween providing a fourth source voltage level from a substantially charged said first battery having an instant value intermediate between the first source voltage level and the second source voltage level, reselecting the lamp to have a rated filament voltage less than the fourth source voltage level;

coupling the reselected said lamp effectively with the first battery said interterminal when the instant value of the fourth source voltage level which may be delivered by a substantially charged said first battery is at least about the rated filament voltage; and, blocking any substantial level of the variably impeded flow of power between the lamp and the anticommon terminal.

4. The method for controlling the portable battery operated electric lighting apparatus of claim 3 further comprising steps of:

sensing an instant value of lamp terminal voltage; and, unblocking and increasing an admittance of power flow between the first battery said antiterminal and the lamp in proportion to a decrease in the fourth source voltage level to a value effectively less than the rated filament voltage of the lamp.

5. The method for controlling the portable battery operated electric lighting apparatus of claim 1 comprising steps of:

arranging a second battery to include a second common terminal coupled with the first battery said common terminal intercoupling the second battery's anticommon terminal, a unilateral semiconductor device and the lamp;

predetermining a maximum fully-charged second battery level as a fourth source voltage level substantially higher than the second source voltage level that may be produced by and appear between the second anticommon terminal and the second common terminal of the second battery;

steering a preferential flow of electric power through the unilateral semiconductor device and thereby between the second anticommon terminal and the lamp;

fully impeding the flow of power between the first battery and the lamp whenever the fourth source voltage level measurably exceeds a first predetermined level having a value less than that of the rated filament voltage of the lamp;

enabling the variable impeding of the flow of power between the first battery and the lamp when the fourth source voltage level decreases to a discharged value less than the first predetermined level.

6. The method for controlling the portable battery operated electric lighting apparatus of claim 1 comprising steps of:

tapping the first battery between a common terminal and anticommon terminal thereof to include an interterminal providing a fourth source voltage level from a substantially charged said first battery having an instant value intermediate between the first source voltage level and the second source voltage level relative with the common terminal;

disabling the first transistor impeder when the fourth source voltage measurably exceeds a predetermined threshold level;

reselecting the lamp for the rated filament voltage to be preferably less than the predetermined threshold level;

unilaterally coupling a flow of current between the interterminal and a juncture between the first transistor impeder and the lamp and, sensing the fourth source voltage level and producing a depletion signal when the first battery discharges and the sensed fourth source voltage level decreases to substantially that of the predetermined threshold level and thereupon utilizing the depletion signal to effectively enable the first transistor impeder to allow at least partial power to flow between the common terminal and the anticommon terminal of the first battery and the lamp.

7. The method for controlling the portable battery operated electric lighting apparatus of claim 1 comprising steps of:

determining a brightness signal by sensing a relative illuminative brightness level of the lamp;

increasing the momentary voltage drop which may develop across the first transistor impeder in proportion to an increase in level of the brightness signal above a threshold level.

8. A control means utile with portable flashlight and electric lantern apparatus for producing stable operation of an incandescent lamp by a battery over a range of usually decreasing battery voltage levels produced during discharge of the battery, comprising:

a first battery means including a common terminal and an anticommon terminal effective for therebetween producing an initial charged first source voltage level which may discharge through a range of third source voltage levels over a period of operating time to an effectively discharged second source voltage value having a lower level usually defined as ⅔ that of the first source voltage level;

an incandescent lamp means selected to have a rated filament voltage preferably 0.4 volt less than the second source voltage level;

a first impeder means comprising a first transistor means seriately coupled between the anticommon terminal and the lamp means;

a means for producing a determinator signal in response to a measure of the lamp means instant filament voltage relative with the rated filament voltage;

a means for effecting controlled variation in the instant impedance of the first transistor means and thereby producing a substantially constant level of current flow through the first transistor means in a directly proportionate response to a change in value of the determinator signal whereby a steady state voltage drop developed across the first transistor means is the greater of the first transistor means collector to emitter saturation voltage, and the difference between the rated filament voltage of the lamp and an instant level of third source voltage produced by the first battery means; and, a means for producing a state of substantially full saturation of the first transistor means and preferably maintaining a less than 0.4 volt (400 millivolt) level of steady state voltage drop across the first transistor means when the third source voltage level discharges to an instant level less than the second source voltage level.

9. The control means of claim 8 comprising:

a base drive means coupled with a base terminal of the first transistor means to establish a minimum level of impedance and a resultant steady state voltage drop of less than 400 millivolts between an emitter terminal and a collector terminal of the first transistor means said seriately coupled between the anticommon terminal and the lamp means; and, a voltage responsive means effective between the base drive means and the lamp means to effect the determinator signal and thereby produce determinable increases in the impedance and said resultant steady state voltage drop developed between the emitter and the collector terminal to thereby effect a stable level of terminal voltage across the lamp means.

10. The control means of claim 8 comprising:

a base drive means including a second transistor means coupled with a base terminal of the first transistor means to effect a variation of impedance and a resultant variation of the steady state voltage drop obtained between an emitter terminal and a collector terminal of the first transistor means being said seriately coupled between the anticommon terminal and the lamp means;

an intermediate drive means including a third transistor means coupled with the second transistor means to determine a level of substantially constant current flow therethrough;

a voltage responsive means coupled between the intermediate drive means and the lamp means to effect the determinator signal and produce a metered variation in the determined level of the constant current flow obtained through the second transistor means thereby effecting a determined variation in the voltage drop developed between the emitter and collector terminal of the first transistor means and develop a substantially constant level of terminal voltage across the lamp means; and, a means for enabling the intermediate drive means to produce a maximal flow of current through the second transistor means and establish a level of minimal impedance across the first transistor means when the third source voltage said discharges to an instant level less than the second source voltage level.

11. The control means of claim 8 comprising:

said first battery means including an interterminal means effective for producing an initial charged fourth source voltage level having a value intermediate between the first source voltage level and the second source voltage level relative with the common terminal and discharging through a range of sixth source voltage levels which extends between that of the fourth source voltage level and a discharged level about ⅔ that of the first source voltage level;

said incandescent lamp means reselected to have a rated filament voltage preferably at least 0.4 volt less than the fourth source voltage level;

a means coupled between the interterminal and a juncture between the lamp means and the first transistor means effective for enabling power flow from the interterminal to the juncture and blocking reverse power flow; and, a means inclusive with the determinator signal producing means for producing an inhibit level signal having a value whereby the current flow through the first transistor means is inhibited whenever the fourth source voltage level is at least the rated filament voltage level.

12. The control means of claim 8 comprising: a second battery means including second a common terminal and a second anticommon terminal and therebetween producing an initial charged fourth source voltage level and discharging through a range of sixth source voltage levels over a period of operating time to an effectively discharged fifth source voltage level having a value about ⅔ of the first source voltage level;

a second battery means coupled serially with the first battery means to provide an interterminal juncture between the common terminal of the first battery means and the anticommon terminal of the second battery means;

a unilateral impeder means coupled between the interterminal juncture and the lamp means for enabling a flow of current between the interterminal and the lamp means whenever a fourth voltage level present at the interterminal juncture exceeds a first predetermined threshold level having a value about that of the second source voltage level;

a disablement means coupled with the first impeder means to impede current flow therethrough whenever the fourth voltage level exceeds the first predetermined threshold level; and, a changeover means including a voltage sensor means coupled with the interterminal juncture and effective to enable the first impeder means and usually disable the unilateral impeder means when an instant value of said fourth source voltage discharges to a level effectively less than the second source voltage level.

13. The control means of claim 8 comprising:

said first battery means including an interterminal means effective for producing an initial charged fourth source voltage level between the interterminal and the common terminal and having a value intermediate between the first source voltage level and the rated voltage level of the lamp means;

said incandescent lamp means reselected to have a rated filament voltage preferably at least 0.4 volts less than the fourth source voltage level;

a second impeder means including a unilateral semiconductor means coupled between the interterminal and a juncture between the first transistor means and effective for superinducing a current flow to the lamp means;

a voltage responsive disabler means coupled with the first impeder means to impede a flow of current therethrough whenever the fourth source voltage level exceeds that of a predetermined threshold level;

a changeover means including a voltage sensor means effectively coupled with the interterminal means of the first battery means and effective to enable the first impeder means when the fourth source voltage level discharges to a level effectively less than the predetermined threshold level.

14. The control means of claim 8 comprising:

a MOS-FET (field effect transistor) device comprising the first transistor means and having a drain terminal effective as the collector and a source terminal effective as the emitter and said coupled seriately between the anticommon terminal of the first battery means and the lamp means;

a drain drive means coupled with a gate terminal of the MOS-FET device to produce a modulatable level of gate control voltage and thereby effect a variation of impedance between the source terminal and the drain terminal of the MOS-FET device; and, a voltage responsive means coupled between the gate drive means and the lamp means to produce the determinator signal and effectively modulate the level of the gate control voltage and thereby effect the impedance variation to produce proportional variation in the voltage drop developed between the source terminal and the drain terminal of the MOS-FET device to develop an about constant level of terminal voltage across the lamp means.

15. The control means of claim 8 comprising:

a means for producing a brightness signal determined by at least sensing relative illuminative brightness of the lamp means; and, a means for combining the brightness signal with the determinator signal and thereby decreasing the level of current flow through the first transistor means in proportion to an increase in the illuminative brightness to an intensity level usually above that of a determinable threshold.

16. The control means of claim 8 comprising:

a means for producing a manual dimming signal which is adjustable by an operator;

a means for combining the manual dimming signal with the determinator signal and to produce a variation in the level of current flow through the first transistor means in proportion to an intentional adjustment of the manual dimming signal by the operator whereby the voltage drop developed across the first transistor means is preferably at least the difference between the rated filament voltage of the lamp and an instant value of the third source voltage level.

17. The control means of claim 8 adapted to permit a regularly pulsed flashing of the lamp means usually occurring at a pulse rate between about 0.1 and 100 pulses per second, comprising:

an interrupter means including at least the first transistor means further effective as a pulsed power controller to alternately interrupt and admit power flow between the first battery means and the lamp means; and, a pulse control means coupled with the interrupter means to establish at least one of a period and a periodicity for the alternant power flow inhibition and admittance and whereby at least one of the period duration and periodicity rate may be operator adjustable.

18. A control means for stabilization of effective illuminative performance of an incandescent light bulb operated from a battery means typical of a portable luminaire apparatus, comprising:

a first battery means producing a range of first intermediate voltage levels usually extending between a higher fully charged first voltage level and a lower effectively discharged second voltage level selected to have a value usually less than ⅔ that of the first voltage level;

an incandescent lamp means having a rated filament voltage preferably at least 0.4 volt less than the second voltage level;

a first transistor means including a collector terminal and emitter terminal;

a seriate circuit means intercoupling the first battery means, the first transistor means and the incandescent lamp means a means for determining a level of steady state first voltage drop developed between the collector terminal and the emitter terminal to be the greater of the first transistor means usual collector to emitter saturation voltage, and the difference between the rated filament voltage of the incandescent lamp means and the first intermediate voltage level of the first battery means; and, a means for sensing a further decrease of the first intermediate voltage level of the first battery means to a predetermined level effectively less than the discharged second voltage level of the first battery means and effect the collector to emitter saturation of the first transistor means and and usually develop a less than 0.4 volt drop between the first battery means and the incandescent lamp means.

19. The control means of claim 18 comprising:

a second battery means producing a range of second intermediate voltage levels usually extending between a higher initial third voltage level and a lower effectively discharged fourth voltage level;

a unilaterally conductive impeder means coupled with a second seriate circuit between the second battery means and the lamp means and effective to produce a current flow therebetween;

an arbiter means effective to disable the first transistor means when the second intermediate voltage level is determined to exceed a predetermined threshold voltage level and further effective to at least enable the first transistor means when the second intermediate voltage is determined to have discharged to an effective level less than the predetermined threshold voltage level; and, a means for sensing a decrease of the second intermediate voltage to an inferior level effectively less than the second voltage level and thereupon effecting a saturation of and a minimal level of about 0.4 volt as the voltage drop developed across the first transistor means.

20. A control means of claim 18 comprising:

a means for producing a periodic pulse signal having a recurrence rate preferably between 0.1 and 100 hertz and including a first level signal portion and an alternate second level signal portion;

a means for gating the first transistor means into a high impedance state in response to the first level signal; and, a means for adjusting at least one of duration and repetition rate of the first level signal portion of the periodic pulse signal.

* * * * *